United States Patent [19]

Winkler et al.

[11] Patent Number: 4,903,953

[45] Date of Patent: Feb. 27, 1990

[54] SIMPLIFIED CURRENCY DISPENSER

[75] Inventors: Theodore Winkler, Levittown, Pa.; Peter L. Helgeson, Laurelton, N.J.; William Sherman, III, Medford, N.J.; Thomas B. Snow, Palmyra, N.J.

[73] Assignee: Brandt, Inc., Bensalem, Pa.

[21] Appl. No.: 183,978

[22] Filed: Apr. 20, 1988

[51] Int. Cl.[4] ..... B65H 5/06

[52] U.S. Cl. ..... 271/4; 271/9; 271/263; 221/7

[58] Field of Search ..... 271/315, 265, 187, 176, 271/258, 259, 162, 4, 9, 263; 221/287, 8

[56] References Cited

U.S. PATENT DOCUMENTS

| | | | |
|---|---|---|---|
| 3,603,680 | 9/1971 | Barton | 271/259 |
| 3,912,255 | 10/1975 | McInerny | 271/187 |
| 4,420,149 | 12/1983 | Schultes et al. | 271/162 |
| 4,436,301 | 3/1984 | Doery et al. | 271/176 |
| 4,474,365 | 10/1984 | DiBlasio | 271/3 |
| 4,691,910 | 9/1987 | Cargill et al. | 271/265 |
| 4,711,441 | 12/1987 | Taylor | 271/259 |
| 4,761,002 | 8/1988 | Reed et al. | 271/265 |
| 4,765,607 | 8/1988 | Zouzoulas | 271/162 |

*Primary Examiner*—Andres Kashnikow
*Assistant Examiner*—Christopher G. Trainor
*Attorney, Agent, or Firm*—Shenier & O'Connor

[57] ABSTRACT

A simplified currency dispenser especially adapted for use at high volume low dollar amount transaction locations. The dispenser is adapted alternatively to transport a selected mix of currency notes from first and second supplies to a delivery location and to display the dollar value of the delivered notes or to transport notes from only one of the supplies to the delivery location and to display the number of notes transported. The dispenser includes a first key pad and display on the dispenser housing for use during a counting operation and a remote key pad and display for use during a dispenser operation. The housing is made in upper and lower sections for ease of manufacture and servicing. It is adapted for either countertop installation or below the counter installation.

14 Claims, 24 Drawing Sheets

10
12
14
16
18
20
22
24
26
30
32
34
36
40
42
44
52
56
62
76
82
90
94
96
98
102
106
107
108
110
112
114
116
118
120
124
128
130
134
136
140
142
170
172
196
204
205
207
208
210
212
213
214
215
216
218
220
222
224
226
236
238
240
242
244
246
248
261
263

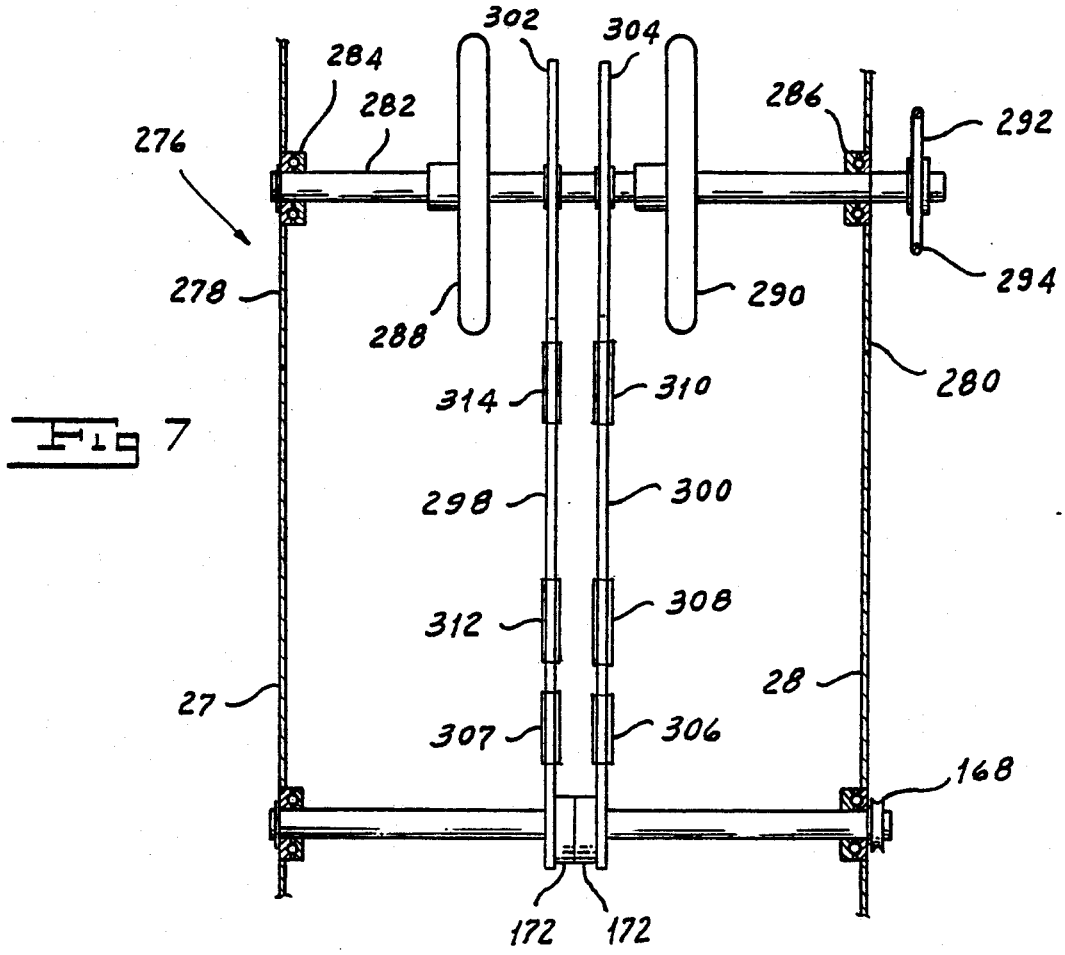
Fig 7
Fig 5
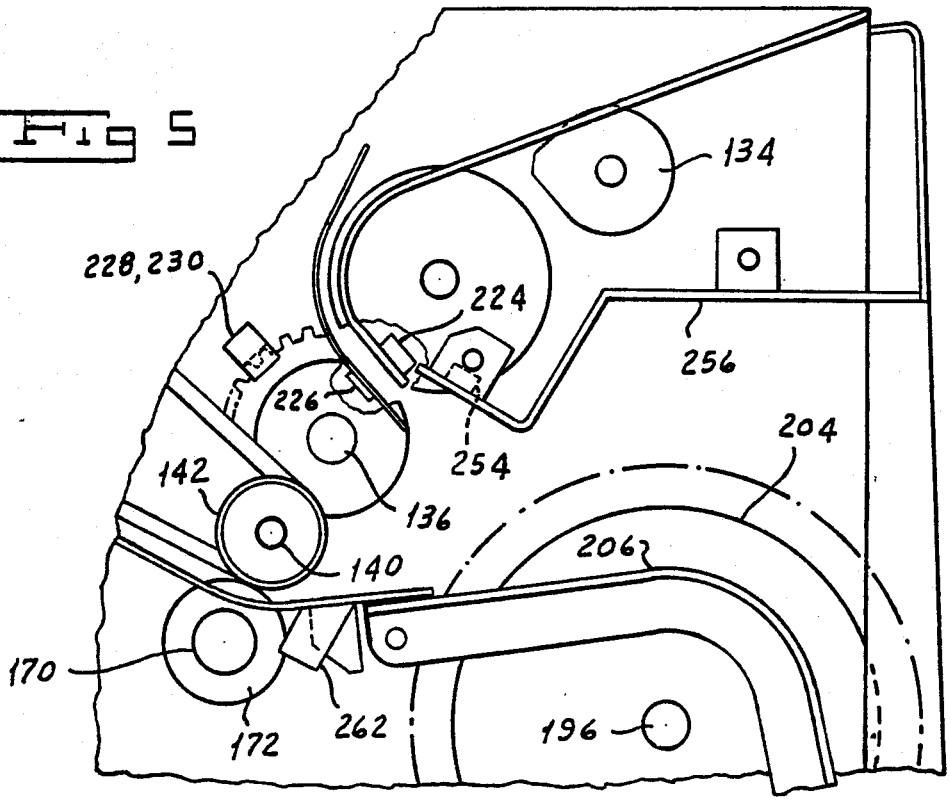

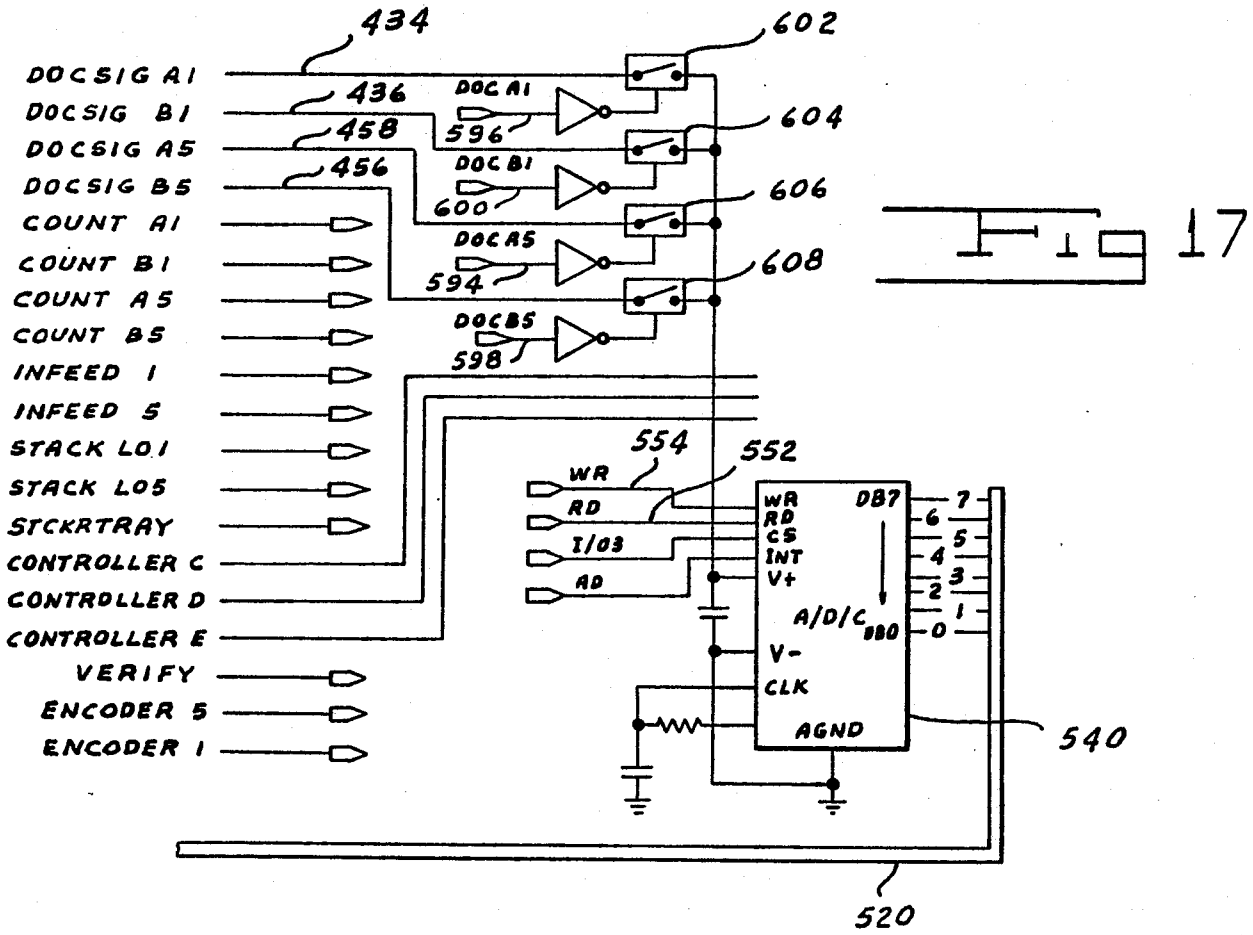
17
540
520
602
604
606
608
552
554
434
436
458
456
596
600
594
598
DOCAI
DOCBI
DOCAS
DOCBS
WR
RD
I/O3
AD
DB7
A/D/C
AGND
V-
CLK
WR
RD
CS
INT
V+
DOCSIG AI
DOCSIG BI
DOCSIG AS
DOCSIG BS
COUNT AI
COUNT BI
COUNT AS
COUNT BS
INFEED I
INFEED S
STACK LOI
STACK LOS
STCKRTRAY
CONTROLLER C
CONTROLLER D
CONTROLLER E
VERIFY
ENCODER S
ENCODER I

SIMPLIFIED CURRENCY DISPENSER

FIELD OF THE INVENTION

The invention is in the field of currency dispensers and relates more particularly to a currency dispenser especially adapted for use at installations involving a high volume of low dollar amount transactions.

BACKGROUND OF THE INVENTION

There are known in the prior art a number of devices for dispensing currency from a number of supplies corresponding respectively to different denominations of bills. One example of such a currency dispenser is shown and described in U.S. Pat. No. 4,660,882. Currency dispensers of the type shown in this patent are particularly adapted for use in relatively secure installations such as banks and the like, wherein each individual transaction involves a relatively large sum of money. At such an installation, moreover, the number of transactions per unit time is not particularly significant.

There are many locations at which a very large number of relatively low dollar amount transactions must be accomplished in a short period of time. Retail outlets such as fast food stores and convenience stores are examples of such locations. It will readily be appreciated that the speed and accuracy with which transactions can be carried out in such locations contributes to the overall volume of business and result in profit to the proprietor. Customer satisfaction is enhanced by any reduction in the period of time the customer must wait in line.

Recognizing the desirability of the use of an automatic currency dispenser in a location such as a fast food shop, consideration must also be given to other factors. The dispenser must be accurate and reliable. It must be secure. It should be simple and inexpensive for the result achieved thereby. It should be compact to permit its use on relatively crowded countertops. It is desirable that it have under counter capability both for security and space saving considerations. It should be compatible with coin dispensing mechanisms. It should be relatively easy to manufacture and to service.

SUMMARY OF THE INVENTION

We have invented a simplified currency dispenser which is especially adapted for use where a high volume of relatively low dollar amount transactions are being carried out.

Another object of our invention is to provide a simplified currency dispenser which is accurate and reliable.

A further object of our invention is to provide a simplified currency dispenser which is simple and compact.

Yet another object of our invention is to provide a currency dispenser which is inexpensive.

A still further object of our invention is to provide a simplified currency dispenser which is easy to service.

Other and further objects of our invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views:

FIG. 7 is a plan of the bill elevating mechanism shown in FIG. 6 with parts removed.

FIG. 13 is a schematic view of the motor control circuitry of our simplified currency dispenser.

FIG. 18 is a diagrammatic view of a further portion of the microprocessor board of our simplified currency dispenser.

FIG. 19 is a schematic view of the display control circuitry of our simplified microprocessor.

DESCRIPTION OF THE PREFERRED EMBODIMENT

Figure 1:
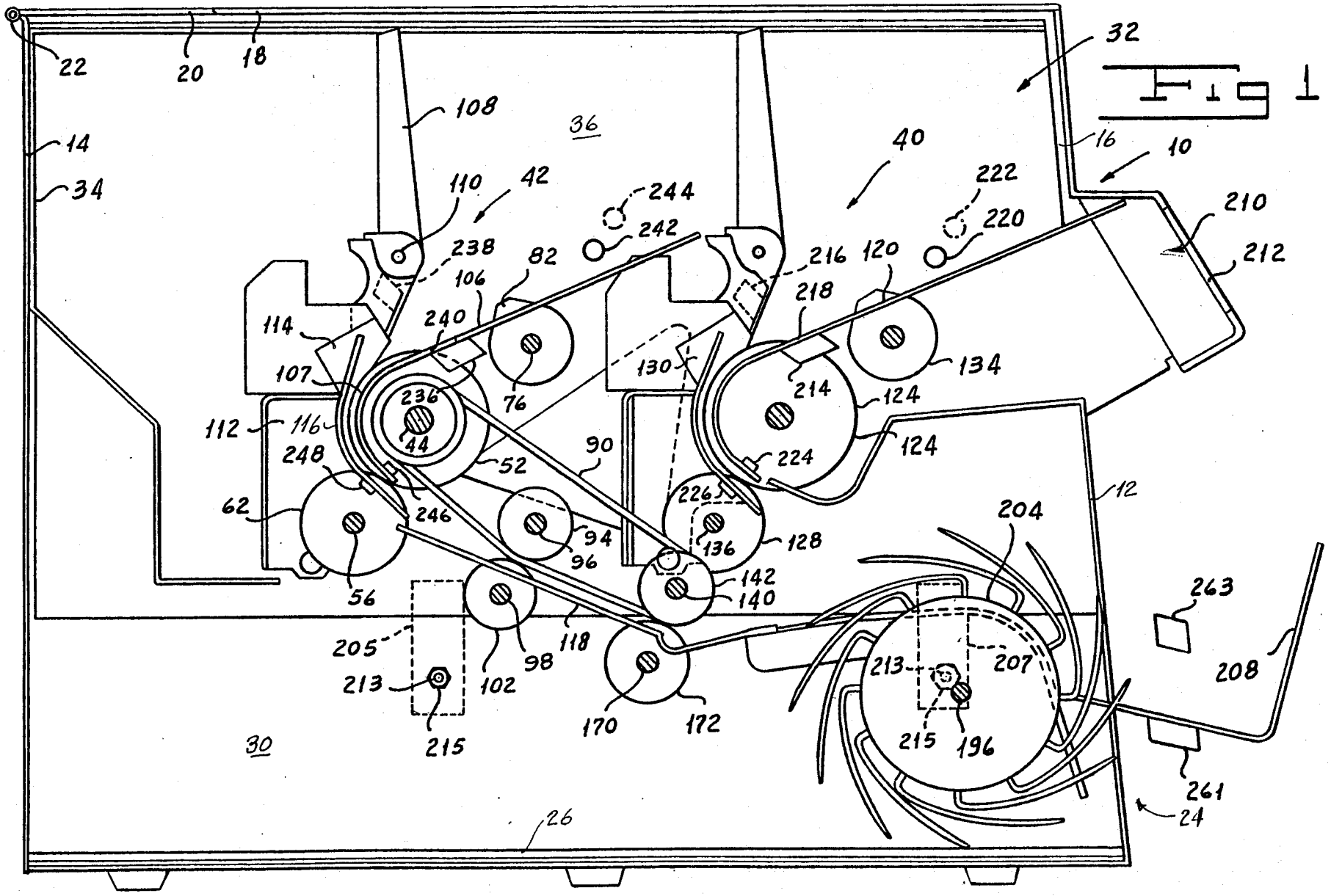
FIG. 1 is a sectional view of our simplified currency dispenser.

Referring now to FIGS. 1 to 5 of the drawings, our currency dispenser, indicated generally by the reference character 10, includes an outer casing having a front wall 12, a back wall 14, side walls 16 and a top wall 18. The top wall 18 includes a cover 20 pivotally mounted on a hinge 22 for movement between an open position at which the supply of bills to be dispensed can be replenished, and a closed position at which the interior of the casing is inaccessible. If desired, a lock may be incorporated in the apparatus to secure the cover in its closed position.

In order to facilitate the manufacture of our dispenser we assemble the apparatus in two parts; one of which is a lower frame section indicated generally by the reference character 24, comprising a base 26 and side walls 28 and 30 spaced inboard from the lateral edge of the base plate 26. An upper frame section indicated generally by the reference character 32 of our apparatus includes a back wall 34, and spaced side walls 36 and 38 which register with the side walls 28 and 30 of the lower section 24.

Our dispenser includes a first dispensing unit indicated generally by the reference character 40 which may, for example, be adapted to dispense a note of the lowest denomination, such for example as a one dollar bill. A second unit indicated generally by the reference character 42 may be arranged to dispense bills of the next to lowest denomination of currency, such for example as five dollar bills.

Since the units 40 and 42 are substantially identical, only the unit 42, for example, will be described in detail. In connection with this description, it is to be understood that for purposes of clarity, the locations of the shafts in FIG. 2 have been shown as being all in the same plane and accordingly spaced along the length of the upper frame section 32.

The unit 42 includes a feed roller shaft 44 rotatably supported in respective bearings 46 and 48 carried by the sides 36 and 38 of the upper frame unit 32. A pair of upper feed rolls 50 and 52 are supported in spaced relationship on the shaft 44 for rotation therewith. An upper idler accelerating roller 54 is carried by the shaft 44 between the two rollers 50 and 52.

We mount a lower accelerator roller shaft 56 in bearings 58 and 60 carried by the walls 36 and 38 of the upper section 42. Shaft 56 supports for rotation therewith a lower accelerating roller 62 at a location at which it cooperates with the upper accelerating roller 54. Shaft 56 also carries a gear 64 which meshes with a gear 66 carried by shaft 44 for rotation therewith. A pulley 68 is adapted to be driven in a manner to be described to rotate shaft 56.

Shaft 44 also carries a pulley 70 of reduced diameter which is adapted to drive a timing belt 72 which also engages a pulley 74 carried by a shaft 76 supported in respective bushings 78 and 80 carried by the sides 36 and 38. Shaft 76 supports a picker roller 82 which, in operation of the apparatus, is adapted to remove the lowermost sheet of a stack supported thereabove and to feed it to the rolls 52.

Respective one-way clutch bearings 83 and 85 mount pulleys 84 and 86 on shaft 4 at positions outboard of the feed rollers 52. Pulleys 84 and 86 receive respective belts 88 and 90. These belts 88 and 90 extend around respective pulleys 92 and 94 rotatably supported on a fixed shaft 96 extending between the sides 36 and 38. Another fixed shaft 98 extending between the sides 36 and 38 rotatably carries a pair of rollers 100 and 102 at locations corresponding to the pulleys 92 and 94 so that the rollers 100 and 102 cooperate with the belts 88 and 90 to advance bills in a manner to be described.

The fives dispenser 42 includes a support 106 adapted to receive a stack of sheets or bills to be dispensed. A sheet retainer 108 is supported on a pivot 110 carried by a bracket 112 pivotally mounted on the frame. Bracket 112 also carries a sheet stripper assembly 114 which cooperates with the feed roller 52 to ensure that only one sheet at a time is dispensed.

We form the platform 106 with a pair of lower curved guide portions 107, one of which can be seen in FIG. 1, extending around shaft 44 inside of the outer peripheries of rollers 52 and outboard of the respective rollers. A curved guide 116 cooperates with the feed rollers 52 to guide the leading edge of a sheet to the nip between the acceleration rollers 54 and 62. The operation of the feed rollers 52, shoes 114 and acceleration rollers 54 and 62 in advancing sheets, is more fully described in U.S. Pat. No. 4,474,365 issued Oct. 2, 1984. Sheets delivered by the accelerating rollers 54 and 62 are guided into the nips between belts 88 and 90 and rollers 100 and 102 by a guide 118.

The ones dispensing unit 40 supported on the upper frame section 32 includes a support platform 120, feed rollers 122 and 124, an upper idling accelerator roller 126, a lower accelerating roller 128, strippers 130 and a picker roller 134, all of which function in substantially the same manner as do corresponding elements of the unit 42. The shaft 136 which supports the lower accelerating roller 128 carries a pulley 138 adapted to be driven in a manner to be described to drive the elements of the unit 40.

Belts 88 and 90 extend around respective grooves in an upper drive through roller 142 rotatably supported on a stationary shaft 140. We loosely mount the ends of shaft 140 in the sides 36 and 38 to permit it to be biased to an operative position by respective springs 141 and 143.

The structure thus far described is assembled with the upper frame section 42 before the two frame sections are secured in cooperative relationship. We have found that this operation greatly facilitates the manufacture of the completed assembly.

A motor 144 having a shaft 146 supported in a side wall 28 of the lower frame section 24 carries a pulley 148 which drives a belt 150. When the two frame units 24 and 32 are assembled in cooperative relationship the belt 150 is engaged with the pulley 68 so that upon energization of the motor 144 the fives dispensing unit 42 is driven.

A second motor 152 has a shaft 154 supported in wall 28. Shaft 154 carries a pulley 156 which drives a belt 158. When the apparatus is assembled, belt 158 is engaged with pulley 138 so that upon energization of motor 152 pulley 138 is driven to cause the ones dispensing unit to operate.

A third motor 160 having a shaft 162 rotatably supported in side 28 is adapted to drive a pulley 164 which receives a belt 166. Belt 166 is adapted to drive a pulley 168 carried by a shaft 170 rotatably supported in the sides 28 and 30 of the lower frame section. Shaft 170 carries a lower feedthrough roller 172 which cooperates with roller 142 to advance sheets o the stacker mechanism to be described.

Figure 5T:
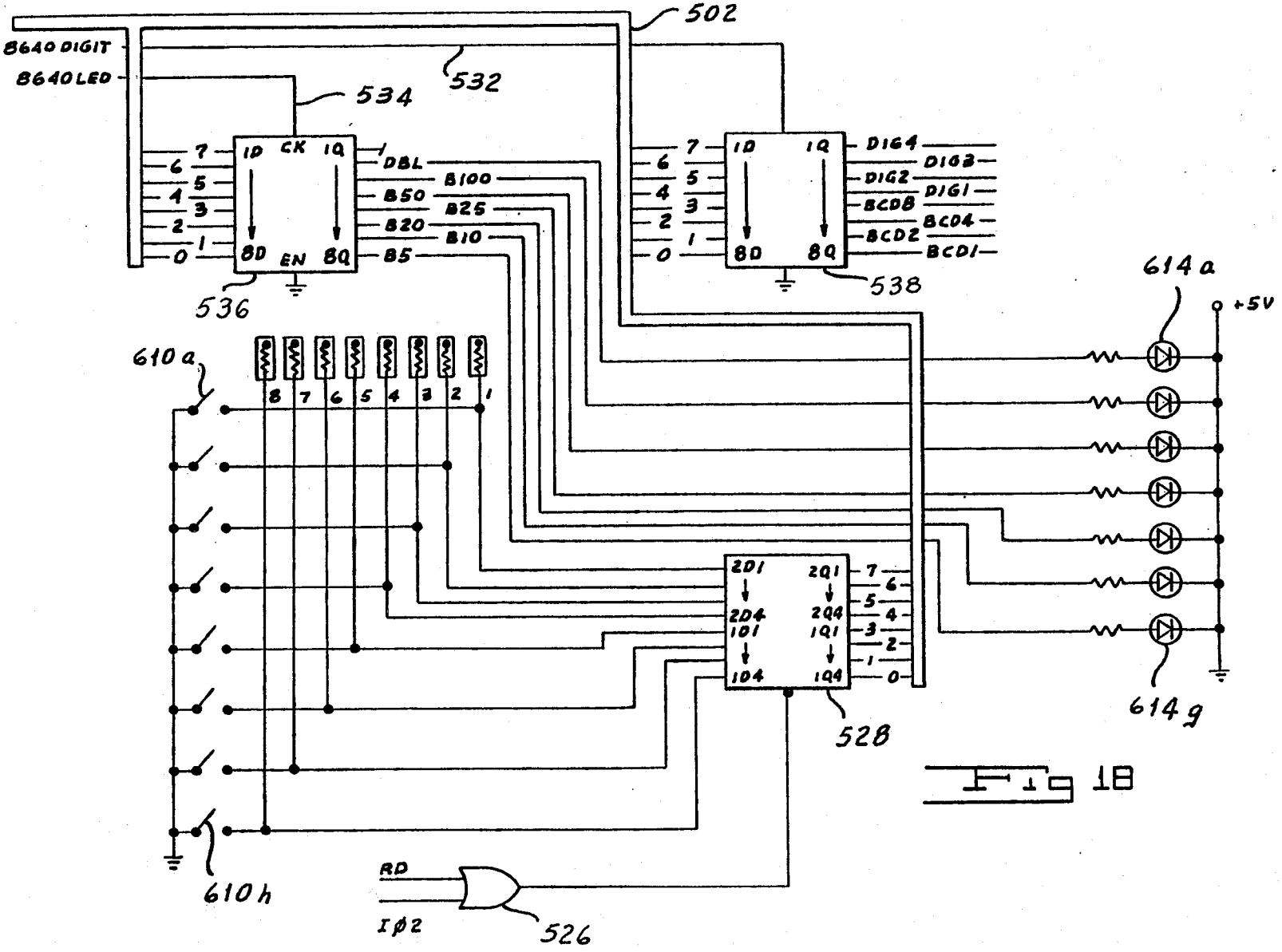
FIG. 5 is a fragmentary sectional view of one of the dispensing units of our currency dispenser.
Figure 15T:
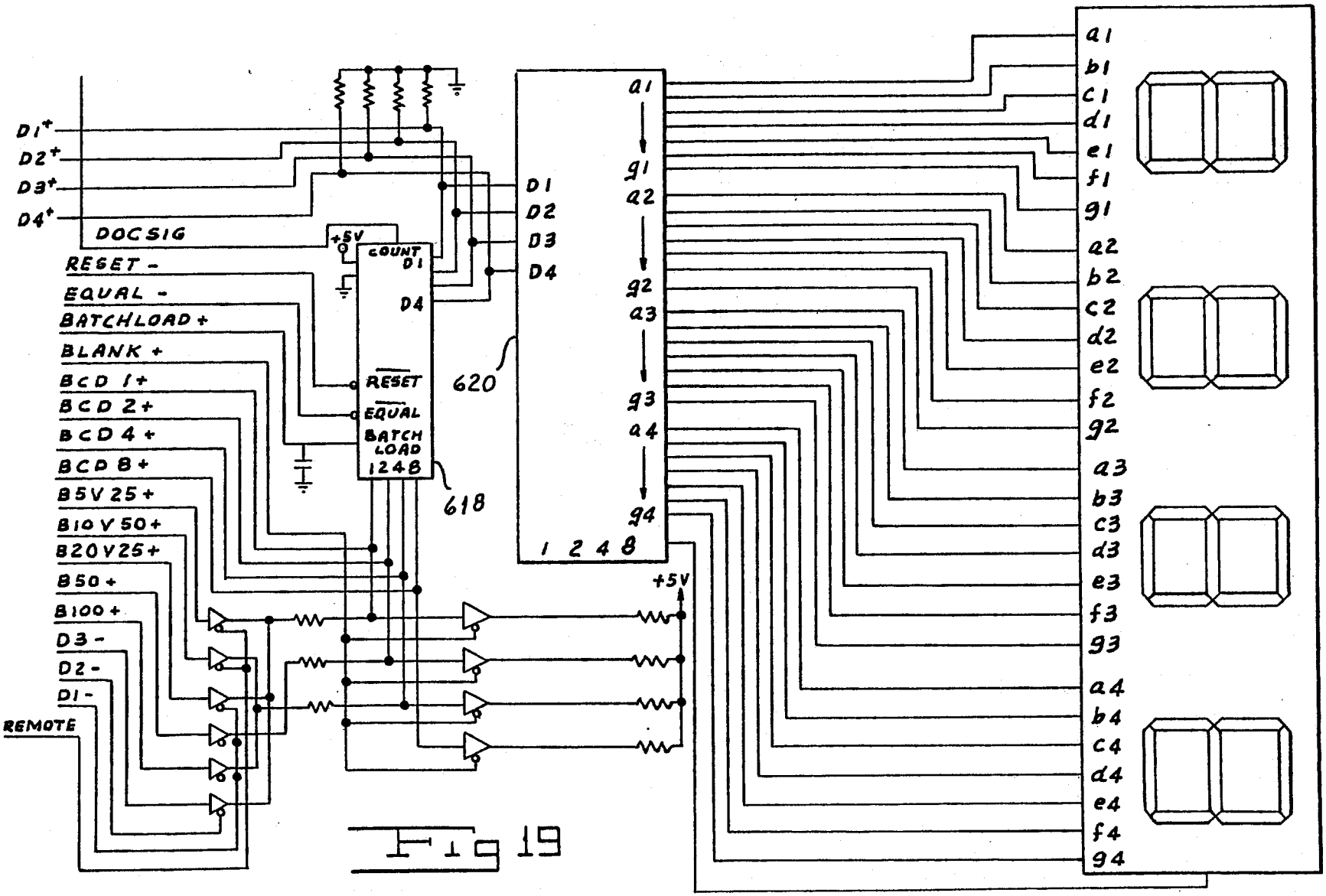

Shaft 162 carries a second pulley 174 which drives a belt 176 extending around an idler pulley 178 rotatably supported on a stub shaft 180 carried by side 28. A second smaller diameter pulley 182 on shaft 180 drives a belt 184 which extends around a second idler pulley 186 rotatably supported on a stub shaft 188 carried by the side 28. A second pulley 190 on shaft 188 drives a belt 192 which extends around a pulley 194 carried by the stacker shaft 196 rotatably supported in bearings 198 and 200 in the sides 28 and 30 of the lower frame unit. Shaft 196 carries for rotation therewith a pair of spaced stacker wheels 202 and 204. Referring to FIG. 5, a slotted guide 206 receives the sheets delivered by the rollers 142 and 172 to be acted upon by the stacker wheels 202 and 204, and thus delivered to the output tray 208 of the apparatus.

The apparatus includes a push button and display unit indicated generally by the reference character 210 located behind a window 212 formed in an extension of the front part of the top 20.

When the various components save for the belts 150 and 158 have been assembled in the upper and lower halves 32 and 24 in the manner described hereinabove, the upper section 32 is placed on the lower section so that pairs of lugs 205,207 and 209,211 secured to the respective sides 36 and 38 at spaced locations along the lower edges thereof overlie sides 28 and 30. Bolts 213 and nuts 215 hold the sections assembled. It will readily be appreciated that this construction not only facilitates the manufacture of our dispenser but also enables servicing and repair to be expeditiously accomplished merely by separating the sections.

When the upper and lower sections are assembled in the manner described the roller 142, which is carried by the biased shaft 140, moves into engagement with roller 172 to provide a driving engagement therebetween. Under this condition the action of the clutch bearings 83 and 85 come into play. If motor 160 is energized so that shaft 170 is driven at its normal speed, clutch bearings 83 and 85 are overrun. If, however, motor 160 is not energized while bills are being delivered from unit 42, the bearings engage so that roller 142 drives roller 172 and the stacker mechanism. In this way bills are prevented from piling up.

We provide our dispenser with a plurality of sensor pairs for affording indications of various conditions of the apparatus. A first sensor pair including a light source 214 and a phototransistor 216 may be employed to sense the presence of a supply of ones on the tray or platform 120. Light received by phototransistor 216 directly from the source 214 produces a signal indicating absence of any ones on the support 120.

A light source 220 and a phototransistor 222 responsive to light from the source 220 provide a signal indicating that the supply of ones on the support has dropped to below a predetermined level. One of the elements 220 and 222 is placed at one side of the stack and the other at the other side of the stack so as to operate on light received directly from the source.

A source 224 of light arranged at one side of the path followed by a one dollar note being delivered by the roller 124 causes a photodiode 226 to produce an output signal which indicates not only that a bill has been fed, but which also provides a measure of the amount of light transmitted by the bill so as to afford an indication of a double feed in a manner known to the art.

A light source 236 cooperates with a sensor, such as a phototransistor 238, by directing radiation through a window 240 in the platform 106, so that radiation received by element 238 indicates the absence of a stack of bills on platform 106.

Another sensor set including a light source 242 and a detector, such as a phototransistor 244, operates on direct illumination to afford an indication that the stack of fives on the support 106 has fallen to below a predetermined level.

A source 246 and a infrared diode element 248, such as a photodiode, mounted respectively on the curved portion 107 of the platform 106 and on the curved guide 116, afford an indication of the amount of radiation passing through the bill, thus to enable us to generate not only a count signal but also a signal indicating a double feed.

Figure 2:
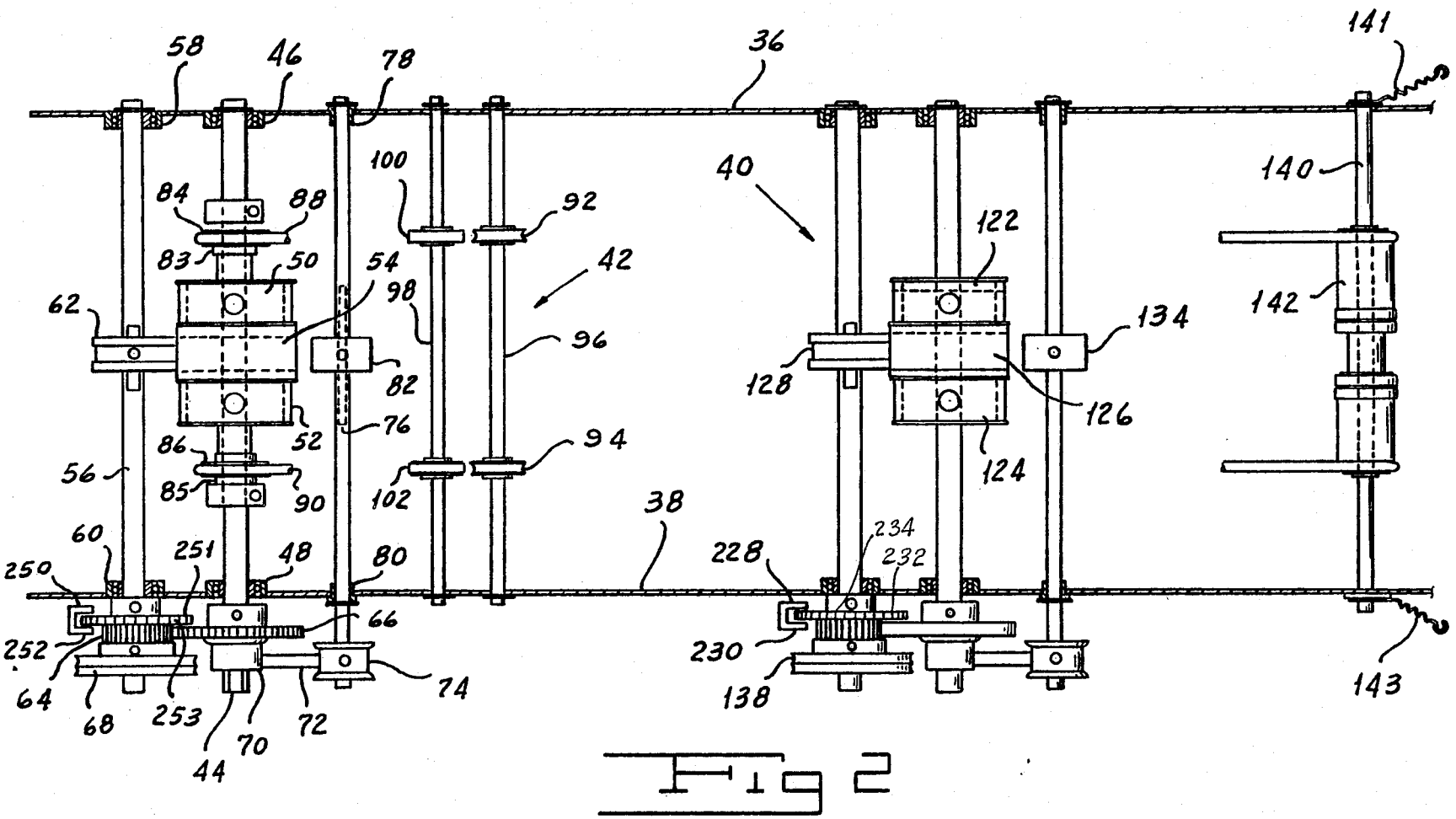
FIG. 2 is a plan view of the drive and roller mechanism of our simplified currency dispenser with the elements shown in the same plane for purposes of clarity.
Figure 3:
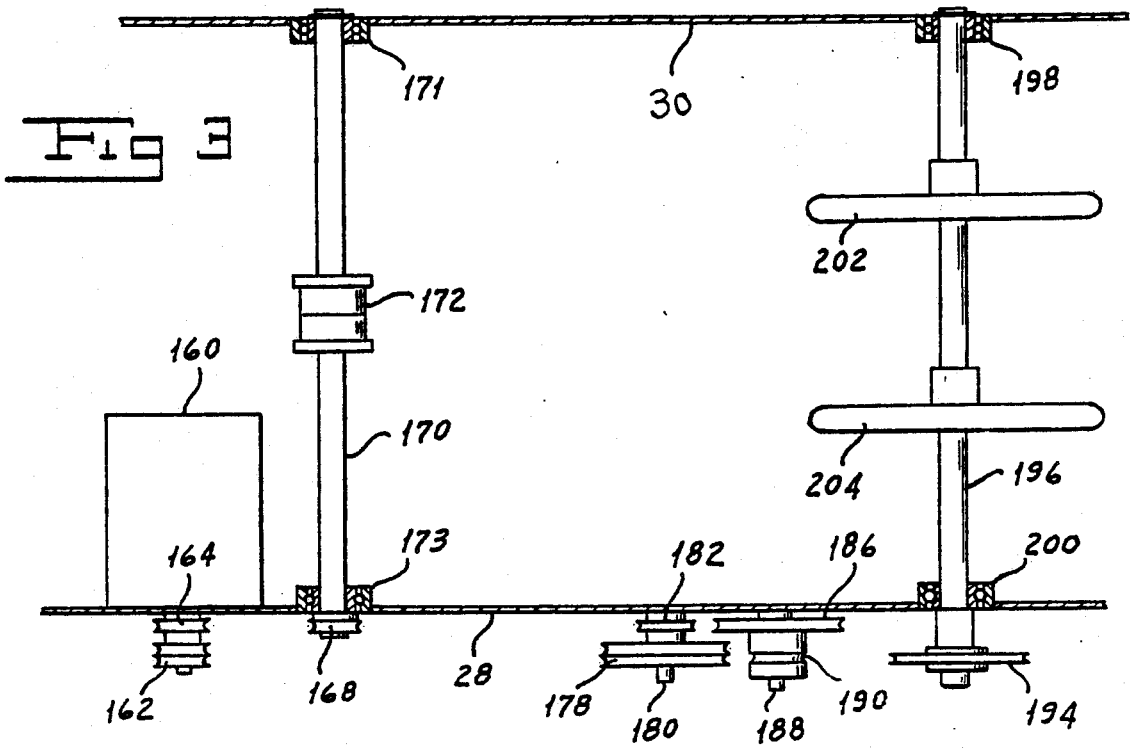
FIG. 3 is a fragmentary sectional view of our simplified currency dispenser.
Figure 4:
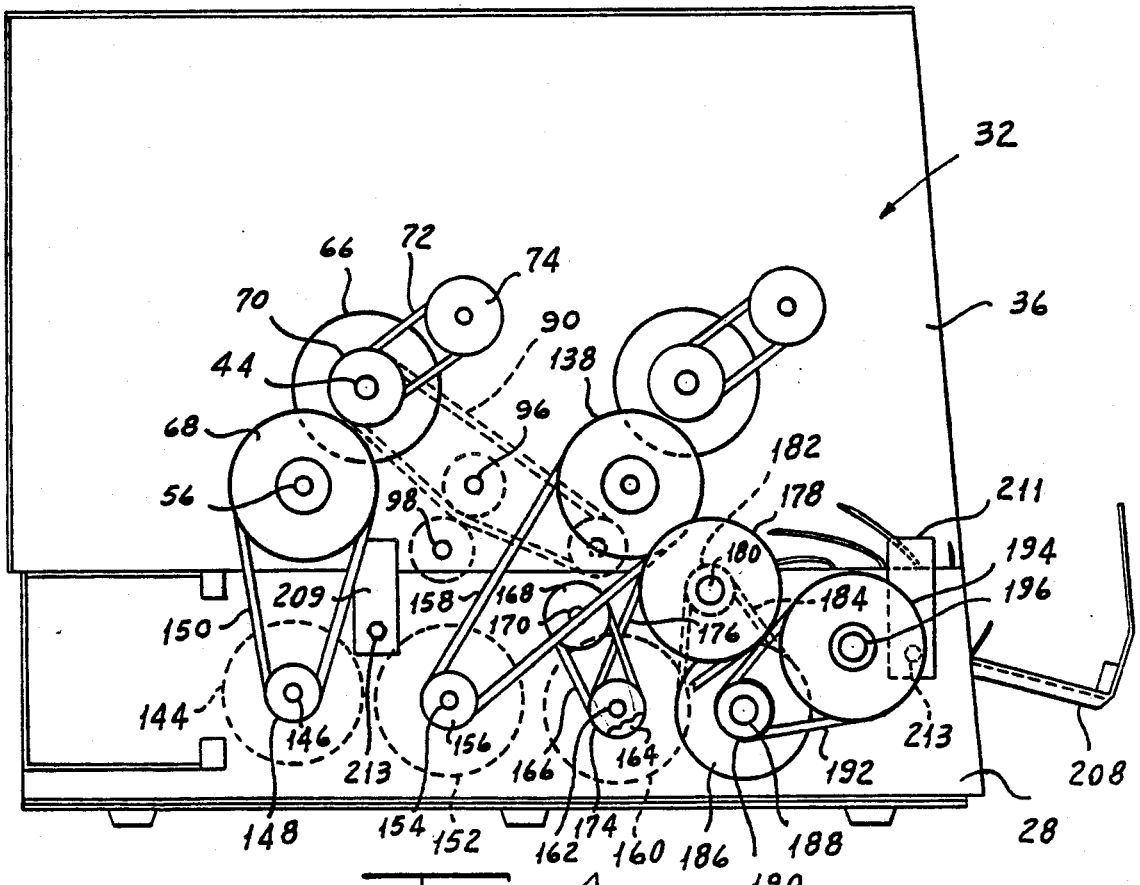
FIG. 4 is a side elevation with the cover removed of our simplified currency dispenser.
Figures 11, 12:
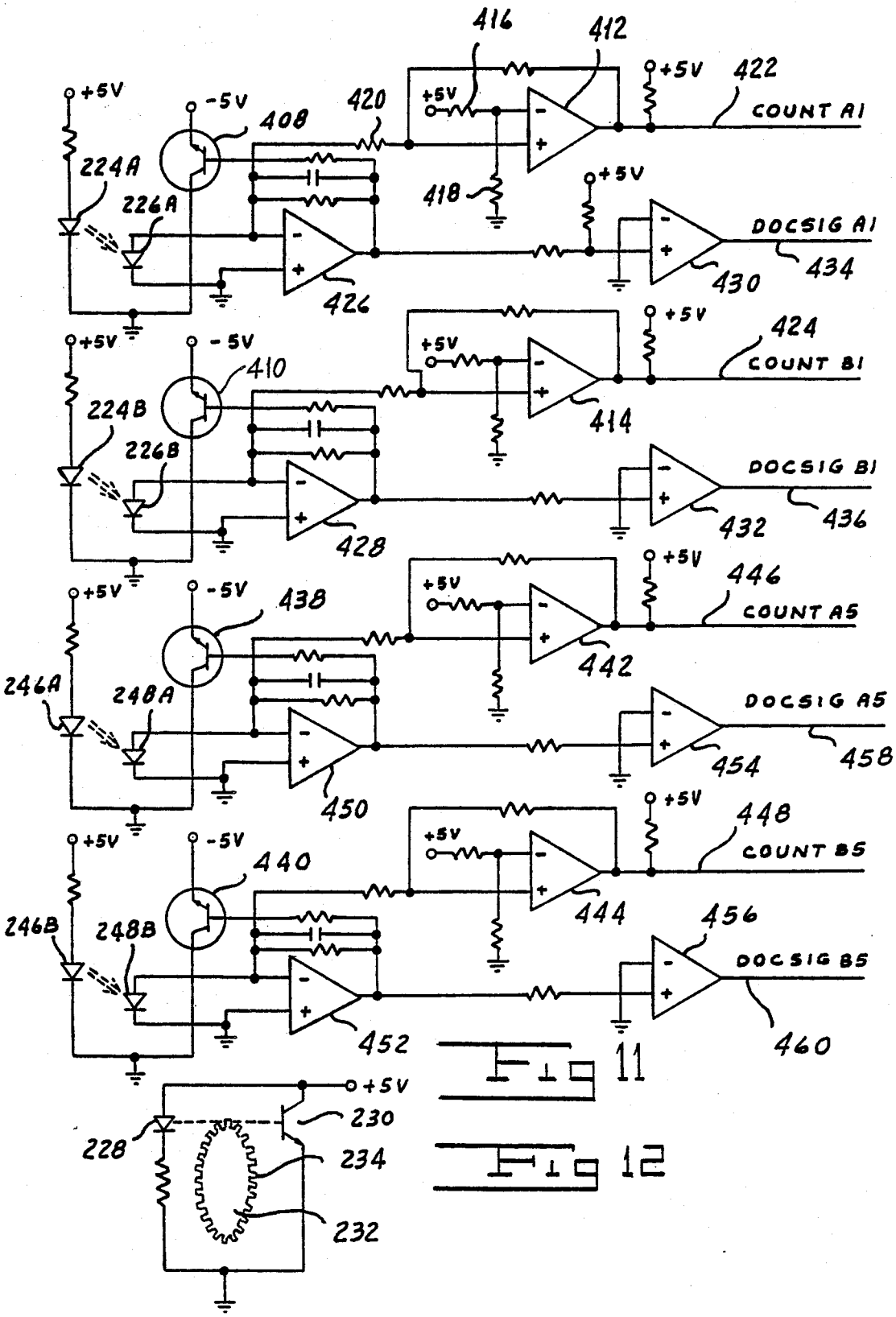
FIG. 11 is a schematic view of another portion of the analog circuitry of our currency dispenser illustrating other sensors.
FIG. 12 is a fragmentary schematic view illustrating a pulse encoder which may be incorporated in our simplified currency dispenser.

Referring to FIGS. 2 and 12, a sensor pair including a light source 228 and a phototransistor 230 cooperate with an encoder wheel 232 on the shaft carrying roller 128 so that the teeth 234 of the wheel generate a train of pulses affording a measure of the length of a note being dispensed by the ones unit. A second sensor pair including a light source 250 and a light sensitive element, such as a phototransistor 252, cooperate with an encoder wheel 251 on shaft 56 so that the teeth 253 of the wheel 251 passing through the space between the elements 250 and 252, causes the generation of a train of pulses affording a measure of the length of a note being dispensed by the fives unit.

Referring now to FIG. 5, we provide our dispenser with means for generating a "verify" signal indicating the fact that a note being fed by a dispenser 40 or 42 has, in fact, reached the stacker wheel 204. We mount a suitable light source 254 on a bracket 256 carried by the upper frame member. Light from the source 254 extends across the path of movement of a one travelling from the unit 40 toward the stacker wheels. This light, after having traversed the one's path, crosses the path of a five being delivered by the rollers 142 and 172 to the stacker. A sensing device 262 supported by guide 118 on the other side of the five's path receives the light. Owing to the fact that this arrangement is common to both the one's path and the five's path and that both the one's delivery and five's delivery units 40 and 42 do not operate at the same time, we are able to achieve the verification signal by the use of only a single pair of elements.

Finally, we provide the output tray 208 with a pair of sensing elements comprising a light source 261 and a light sensitive element 263 such as a photodiode for detecting the presence of one or more bills in the output tray. As will be explained more fully hereinbelow, we employ this signal to inhibit further operation of the machine under certain conditions until the bills have been removed from the output tray.

In some installations it may be necessary or desirable to position the dispenser unit below the surface counter and yet provide for delivery of the bills at or adjacent to the countertop.

Figure 6:
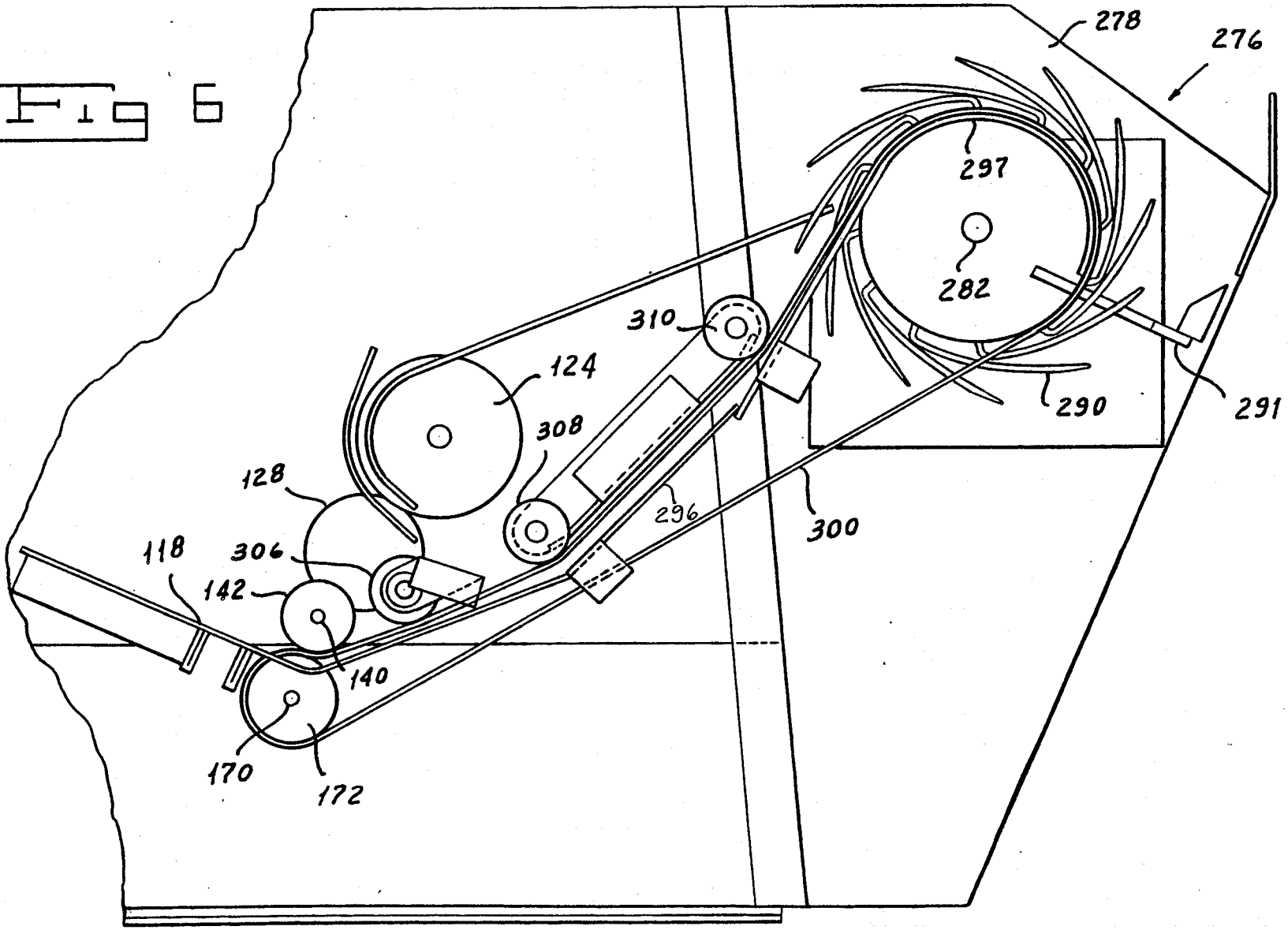
FIG. 6 is a side elevation of an alternate embodiment of our simplified currency dispenser, with parts removed.

Referring now to FIGS. 6 and 7, we have shown an alternate embodiment of our simplified currency dispenser in which we secure a top delivery unit indicated generally by the reference character 276 to the front of the assembled top and bottom sections 32 and 34 of the machine. This may be accomplished by any suitable means known to the art. As will be apparent from the description hereinbelow, this top delivery unit 276 replaces the lower stacker wheels 204 and 206 and the lower delivery tray 208, as well as the display panel 210 of the form of our simplified currency dispenser shown in FIGS. 1 to 5.

The unit 276 includes a pair of side panels 278 and 280 which rotatably support a shaft 282 by means of bearings 284 and 286. Shaft 282 carries for rotation therewith a pair of spaced stacker wheels 288 and 290 for delivering bills to a tray 291 located near the top of the apparatus. Shaft 282 also carries a pulley 292 connected by a belt or 0-ring 294 to the drive pulley 190 carried by shaft 188. It will readily be appreciated that some slight rearrangement of the axes of rotation of the pulleys shown in FIG. 4 may be necessary to prevent interference between the belt 294 and other elements.

When employing the top delivery unit 276, we provide a guide or guides 296 forming an extension of the guides 118 directed generally upwardly towards the stacker wheels 288 and 290 and guides 297 extending around the axis of shaft 282. A pair of belts 298 and 300 extending around rollers 172 are guided around respective relatively larger diameter pulleys 302 and 304 rotatably supported on shaft 282 at positions spaced inboard of the stacker wheels 288 and 290.

It is to be understood that the drive system associated with the top delivery unit 276 is substantially the same as that of the form of our invention shown in FIGS. 1 to 5 in that the belts 298 and 300 are driven at a greater speed than are the stacker wheels 288 and 290 so that bills are positively forced into the spaces between adjacent fingers of the stacker wheels.

We provide respective first hold-down rollers 306 and 307, for the belts 298 and 300. Respective pairs of idler rollers 308 and 310 and 312 and 314 associated with the respective belts 298 and 300 prevent bills from flying away from those portions of the belts extending from the location at which ones are fed upwardly toward the stacker wheels 288 and 290.

From the structure just described, it will readily be apparent that in operation of the form of our currency dispenser shown in FIGS. 6 and 7, bills delivered by the fives unit 42 are received by the upper surfaces of the belts 298 and 300, as viewed in FIGS. 6 and 7, pass under rollers 306 and 307 and are carried upwardly under the pairs of idler rollers 308 and 310 and 312 and 314 and are fed into the pockets formed by adjacent fingers of the stacker wheels 288 and 290. Bills fed by the ones unit 40 are received by belts 298 and 300 at the location between roller 306 and roller 308, as viewed in FIG. 6. Further, as is pointed out hereinabove, the belts 298 and 300, are driven at a somewhat faster speed than the surface speed of the stacker wheels 288 and 290 so that bills are positively forced into the spaces between adjacent fingers of the stacker wheels 288 and 290. As the stacker wheels continue to rotate, they lay successive bills down on a tray 316 from which they can be retrieved bY the operator of the dispenser. It is to be understood that when the form of our currency dispenser illustrated in FIGS. 6 and 7 is installed below the counter at the establishment at which it is located, bills on the tray 316 are accessible at a location just below the top of the counter.

Figure 8:
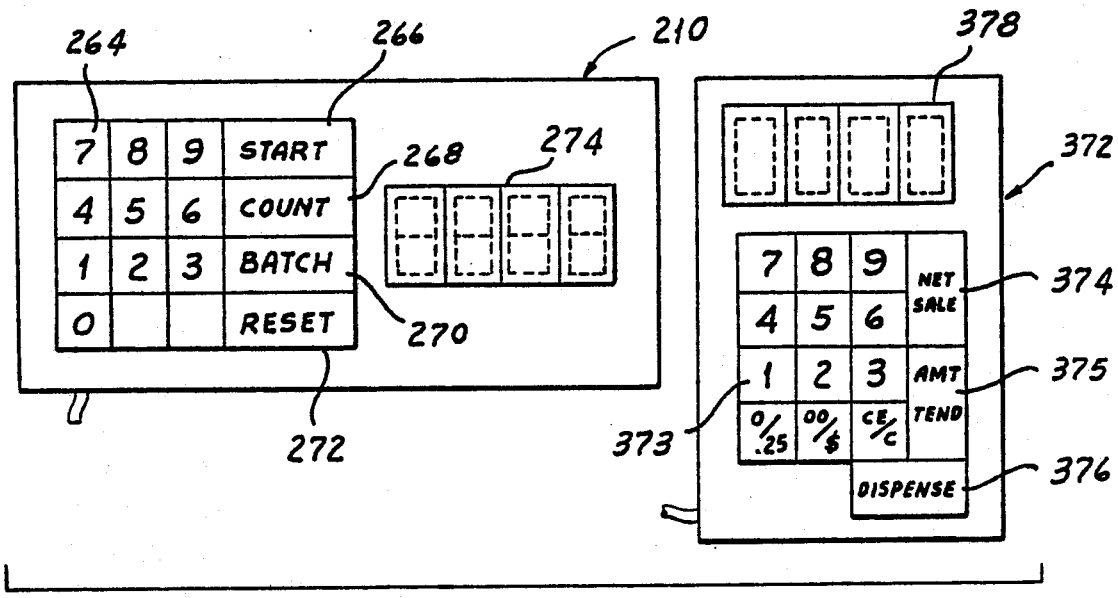
FIG. 8 is a plan view of the keyboard and display portion of our simplified coin dispenser.

Referring now to FIG. 8, the built-in keypad and display panel 210 includes a plurality of numerical pushbuttons 264 which may be actuated to enter information as desired. A START-CLEAR button 266 is actuated to set the unit in the count mode while COUNT, BATCH and RESET buttons 268, 270 and 272 are actuated to control the operation in the count mode. A display 274 gives a visual indication of output information.

Operation of our apparatus in the dispense mode is controlled by a remote or point-of-sale keypad and display unit, indicated generally by the reference character 372. Unit 372 includes a keypad having numerical input keys 373, as well as NET SALE, AMOUNT TENDERED and DISPENSE keys 374, 375 and 376. A display 378 affords a visual indication of output information in the dispense mode.

Figure 9:
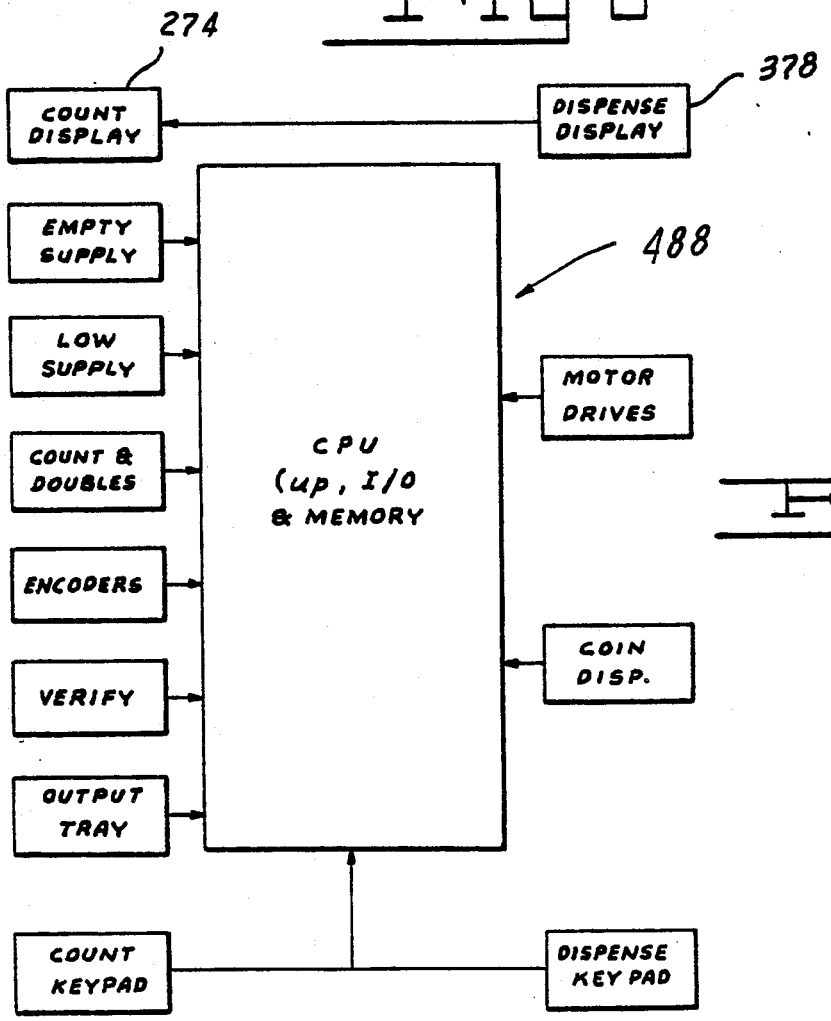
FIG. 9 is a block diagram illustrating the relationship of the central processing unit of our simplified coin dispenser to the peripheral apparatus.
Figure 10:
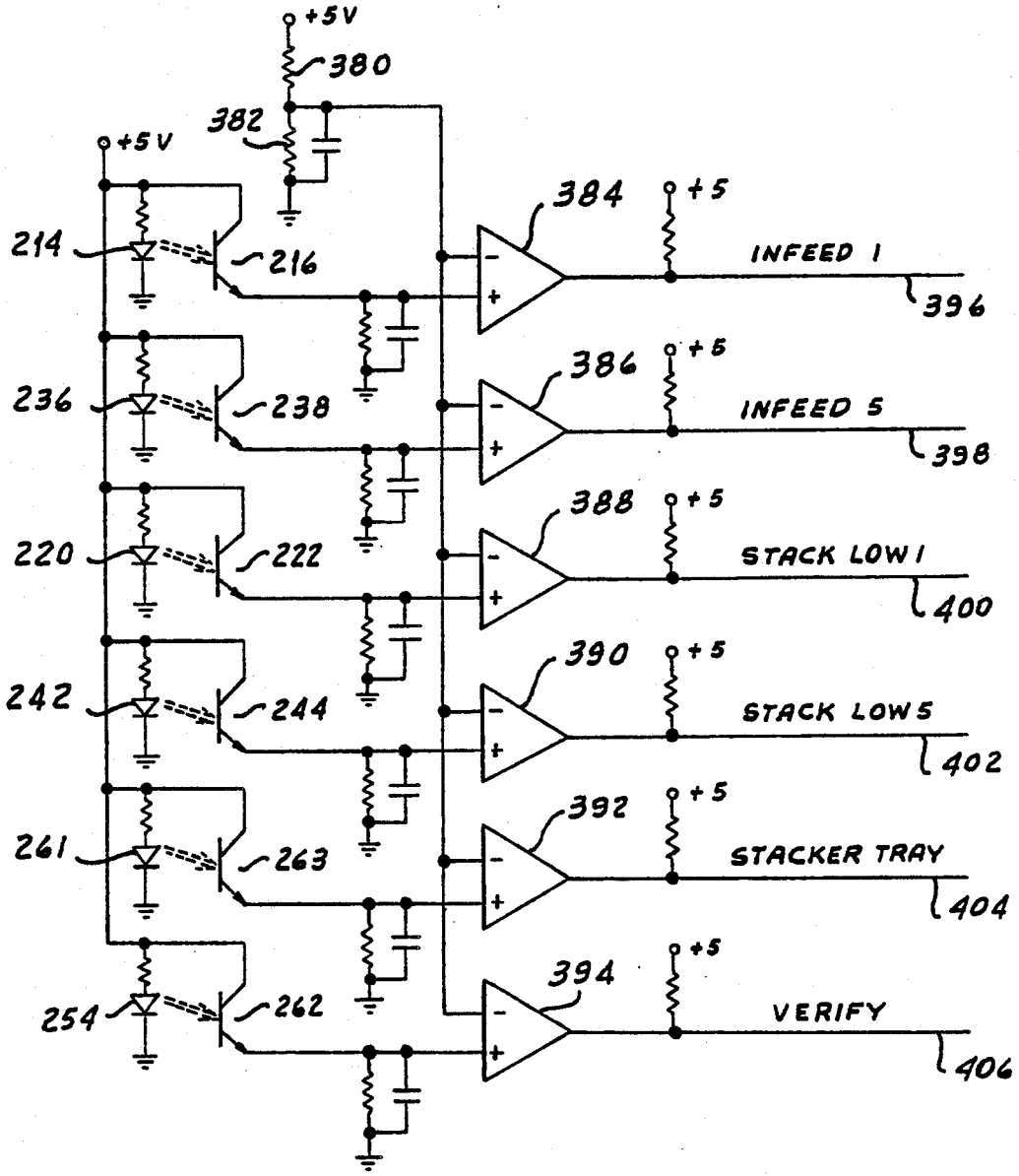
FIG. 10 is a schematic diagram illustrating the portion of the analog circuitry of our dispenser incorporating various sensing means.

Referring now to FIG. 9, we have shown the relationship between the central processing unit indicated generally by the reference character 488 of our apparatus, to be described more fully hereinbelow, and various sources of input information such as the keyboard, the empty supply signal generators, the low supply signal generators, the count and doubles signal generators, the encoders, the verify sensor and the output tray sensor. The central processing unit uses this information in a manner to be described more fully hereinbelow to actuate the display, the motor drives and a coin dispenser, if one is so provided.

Referring now to FIGS. 10 to 13, in the analog portion of the control system of our dispenser, a voltage divider made up of resistors 380 and 382 provides a reference potential which is applied to the inverting terminals of operational amplifiers 384, 386, 388, 390, 392 and 394, associated with the phototransistors 216, 238, 222, 244, 263, and 262. When, for example, light from the diode 214 impinges on the base of transistor 216, the transistor conducts to apply a signal to the non-inverting input of amplifier 384 to indicate that there are no documents in the ones supply tray. Conversely, when a supply of documents is present the nature of the signal on line 396 indicates this fact. Respective output lines 398, 400, 402, 404 and 406 associated with the respective amplifiers 386, 388, 390, 392 and 394 indicate the presence or absence of $5 notes in the $5 input tray, the fact that the stack of ones has or has not reached a predetermined low point, the fact that the stack of fives has or has not reached the predetermined low point, the presence or absence of notes in the stacker tray and a signal indicating that notes dispensed have, in fact, been fed to the stacker.

As has been pointed out hereinabove, we provide a pair of sensors including LEDs 224A and 224B and photodiodes 226A and 226B for producing signals from which a count of the number of ones dispensed may be obtained and from which there is indicated the presence of overlapping bills. Respective feedback networks including transistors 408 and 410 operate to maintain the output level of light from the LEDs 224A and 224B, substantially constant in a manner known to the art. A reference potential is applied to the inverting input of a COUNT operational amplifier by means of a voltage divider made up of resistors 416 and 418. When the light from LED 224A is interrupted, the signal is applied to an input resistor 420 at the non-inverting input of amplifier 412 to produce a COUNT Al signal on an output line 422. In a similar manner, an operational amplifier 414 associated with diode 226B provides a COUNT B1 on line 424. Another operational amplifier 426 responsive to the condition of diode 226A provides an input to operational amplifier 430 to generate a DOCSIG A1 on line 434. Similarly, an operational amplifier 428 responsive to the condition of diode 226B provides a signal for an amplifier 432 to generate a DOCSIG B1 on line 436.

The pair of sensors including LEDs 246A and B and diodes 248A and 248B associated with the $5 note dispensing system are employed to generate signals similar to those described hereinabove in connection with the dispensing of one dollar notes. Respective feedback circuits including transistors 438 and 440 maintain the output light levels of LEDs 246A and 246B substantially constant. Respective operational amplifiers 442 and 444 associated with diodes 248A and 248B provide COUNT A5 and COUNT B5 outputs on lines 446 and 448. Operational amplifiers 450 and 452 are responsive to the conditions of diodes 248A and 248B, actuate amplifiers 454 and 456 to provide DOCSIG A5 and DOCSIG B5 signals on lines 458 and 460.

As shown in FIG. 12, LED 228 is so arranged with reference to wheel 232 and teeth 234 as intermittently to cause light to impinge upon the base of transistor 230 to generate an ENCODE signal for ones. A similar circuit responsive to the output of transistor 252 provides an ENCODE signal for fives.

FIG. 13 illustrates one form of control circuit which may be used to control the 1's and 5's dispensing motors 152 and 144 and the stacker motor 160 by connecting them to a suitable source of DC potential having a terminal 462. A STACKER signal on line 464 renders a transistor 466 conductive to apply the potential at terminal 462 to the motor 160.

A FEED 1 signal on line 468 causes a transistor 470 to apply the potential of terminal 462 to the motor 152. A BRAKE 1 signal on the line 472 renders a transistor 474 conductive to connect a shunt resistor 476 across the motor 152 to brake the motor after the feed signal disappears.

A FEED 5 signal on a line 478 causes a transistor 480 to apply the potential at terminal 462 to the motor 144. After the feed signal disappears, a BRAKE 5 signal on a line 482 renders the transistor 484 conductive to connect a shunt resistor 486 across motor 144 to brake the same.

Referring now to FIGS. 14 to 18, the central processing unit 488 includes a microprocessor 490 such as a Z-80 manufactured by Zilog, Inc. of Campbell, Calif., having a non-maskable interrupt terminal 492 which receives a signal in the event of a power failure, as is known in the art. The microprocessor 490 receives reset pulses at a reset terminal 494 and clock pulses from a suitable pulse generator (not shown) at a terminal 496.

As will be described more fully hereinbelow, in response to the system clock/pulses, the microprocessor feeds address information to a pair of bidirectional buffer circuits 498 and 500 such, for example, as 74HC244 which translate the information to an address bus 502.

Bus 502 feeds the address information into a PROM, such as a TMSC 27256, a counter timer circuit 506, a RAM circuit 508 such as a CDN 6264, a pair of parallel input/output circuits 510 and 512, a serial input/output circuit 514, a third parallel input/output circuit 516 and a second counter timer circuit 518. At the appropriate times, the circuits 506, 508, 510, 512, 514, 516 and 518 feed output data to a data bus 520 leading back to the microprocessor 490.

Respective decoders 522 and 524 which may be 74HC138 circuits respond to information on the address bus selectively to enable various of the circuit chips.

Outputs I01 and I04 to I07 respectively enable chips 510, 518, 512, 516 and 514. I02 provides one input to a 2-input circuit OR 526 coupled to the enable terminal of a buffer/driver/receiver 528, which may be a 74HC244, the function of which will be described more fully hereinbelow. I03 provides an input to the CS terminal of an analog to digital converter 540.

The signal on output line 530 of decoder 524 enables chip 506. Lines 532 and 534 carry signals which clock respective octal flip-flops 536 and 538 which may be 74HC374 chips to couple data from the bus 502 to the display in a manner to be described.

A line 542 provides a clock pulse input to a buffer/driver/receiver circuit such as a 74HC244 to couple the input/output request IORQ, the memory request MREQ, memory read RD, memory write WR and M1 system control output terminals of the microprocessor 490 to respective output lines 546 and 548, 550, 552, 554 and 556 and the halt state HALT output terminal of the microprocessor to a line 560.

Lines 550 and 556 provide inputs for an AND circuit 568, coupled to the enable terminal of a transceiver 566, such as a 74HC245. Lines 546 and 556 provide inputs for an OR circuit 562, the output of which is applied to an AND circuit 564, together with the signal on line 552 to supply an input to the directional input terminal of the transceiver 566. The memory request signal on line 550 provides one input for an OR circuit 570, the other input of which comes from an address bus 502 to provide a signal input for the chip enable terminal of PROM 504. The memory read signal on line 552 is applied to the output enable terminal of memory 504.

The CTC 506 which is enabled by line 530 also receives inputs from the M1 input/output request and read lines 556, 546 and 552.

Figure 15:
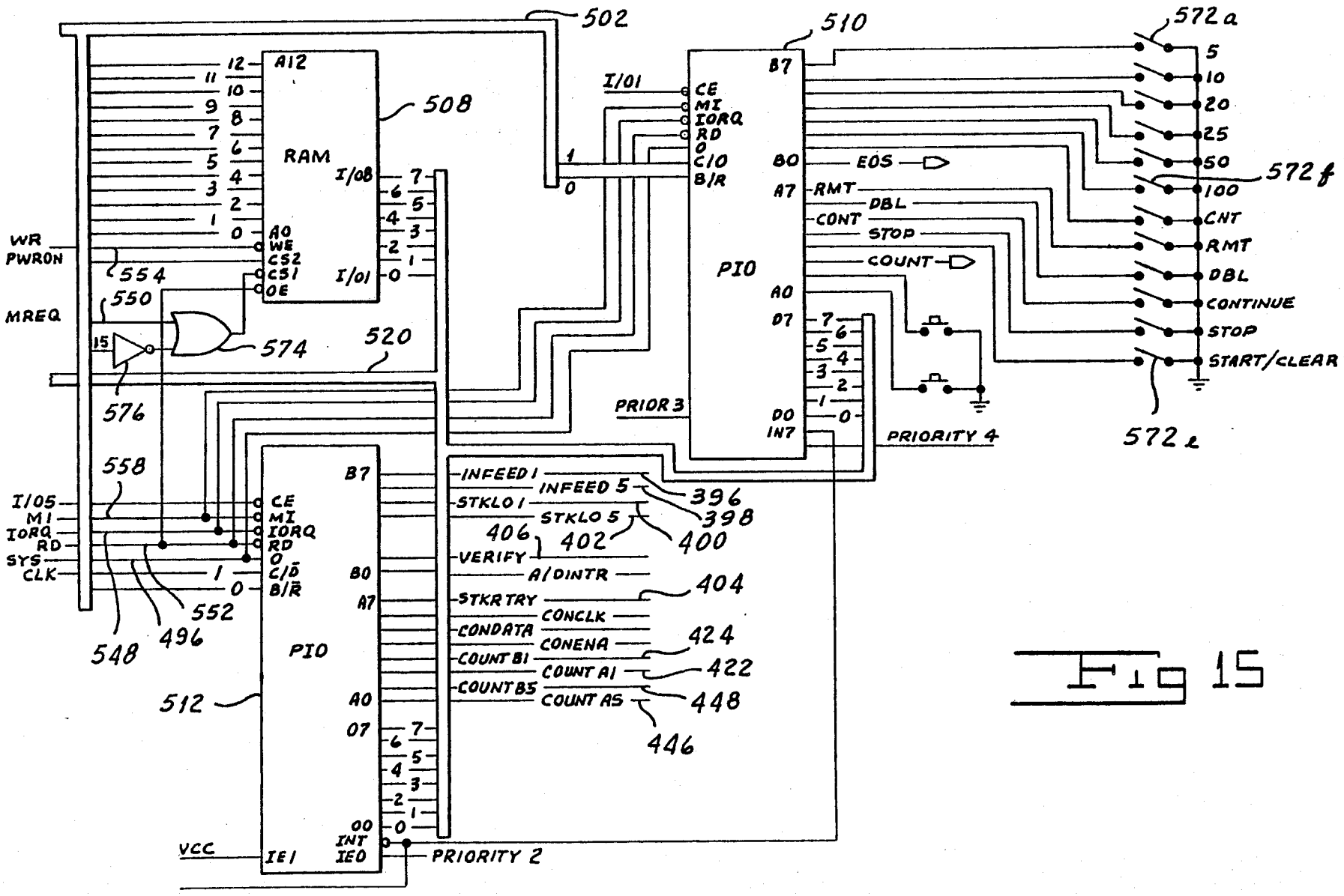
FIG. 15 is a diagrammatic view of another portion of the microprocessor circuitry of our simplified currency dispenser.

Referring now to FIG. 15, the M1, IOREQ, RD and SYS CLK lines 558, 548, 552 and 496 lines provide inputs to the parallel input/output circuits 510 and 512. Circuit 512 receives condition input signals from lines 396, 398, 400, 402, 404, 422, 424, 446 and 448. The circuit 510 receives inputs from keyboard switches **572*a* to 5721. Switches 572*a* to 572*f* correspond to amounts while 572*g* to 1** respectively correspond to COUNT, REMIT, DOUBLE, CONTINUE, STOP and START/CLEAR.

The MREQ signal on line 550 provides one input for an OR circuit 574 which receives its other input from the address bus 502 through an inverter 576 to provide a CS1 input for RAM 508. The RD signal on line 552 provides the output enable signal for chip 508.

Figure 16:
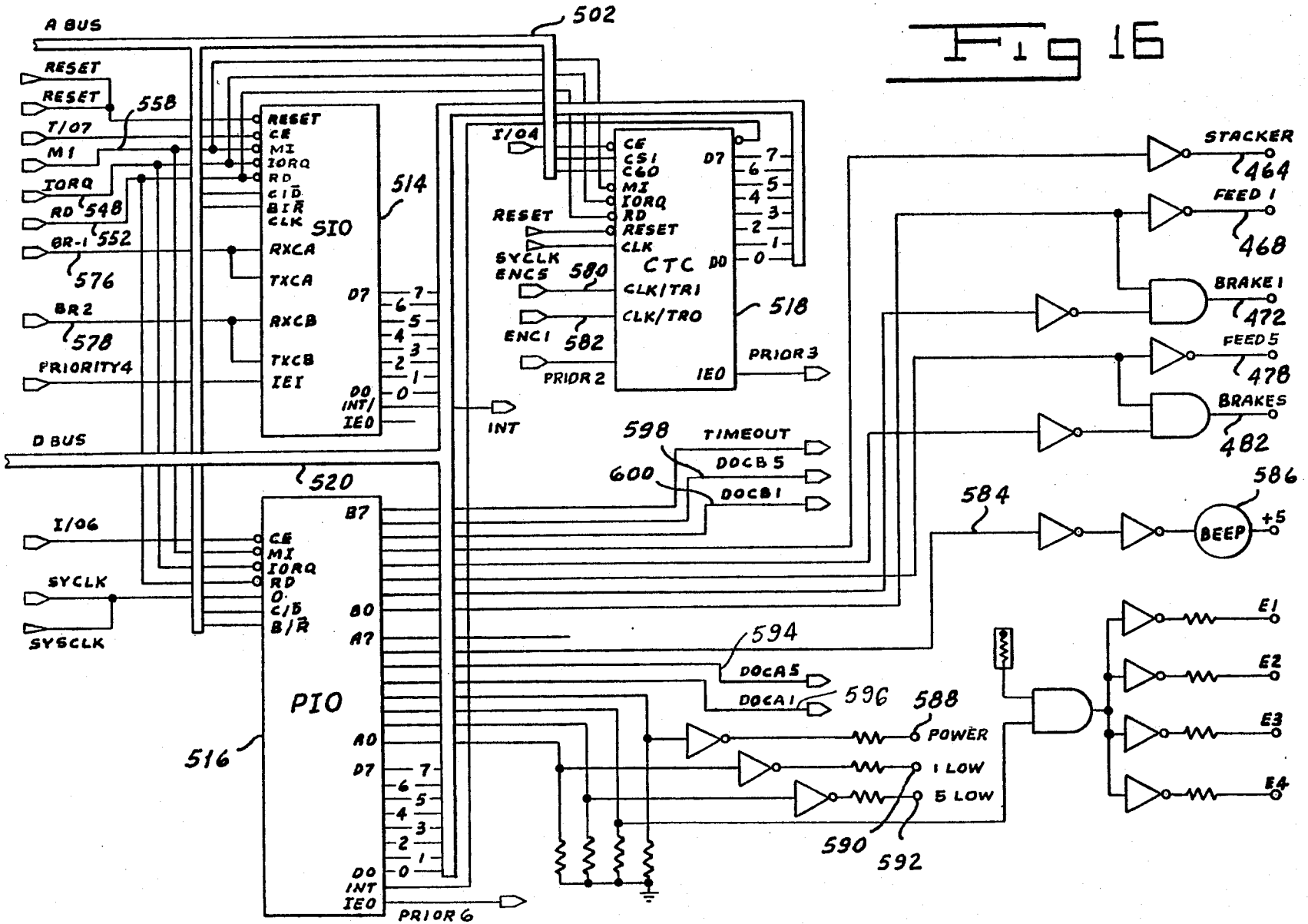
FIG. 16 is a diagrammatic view of a further portion of the microprocessor board of our simplified currency dispenser.

Referring now to FIG. 16, the M1, IOREQ and RD signals on lines 558, 548 and 552 provide inputs for circuits 514, 516 and 518. Conductors 576 and 578 leading from chip 506 provide inputs for SIO 514. Chip 518 receives respective inputs from the fives encoder wheel and ones encoder wheel on lines 580 and 582.

Chip 516 provides the motor control signals described hereinabove on conductors 464, 468, 472, 478, and 482. An output 584 of chip 516 controls a suitable acoustical device 586 to indicate that the supply of currency being dispensed is exhausted. Other outputs of chip 516 indicate a power on condition at a terminal 588, a ones low condition at a terminal 590 and a fives low condition at a terminal 592. These terminals may be connected to suitable indicators.

In addition, the chip 516 puts out DOC A5 and DOC A1 signals on lines 594 and 596, as well as DOC B5 and DOC B1 signals on lines 598 and 600.

Figure 17:
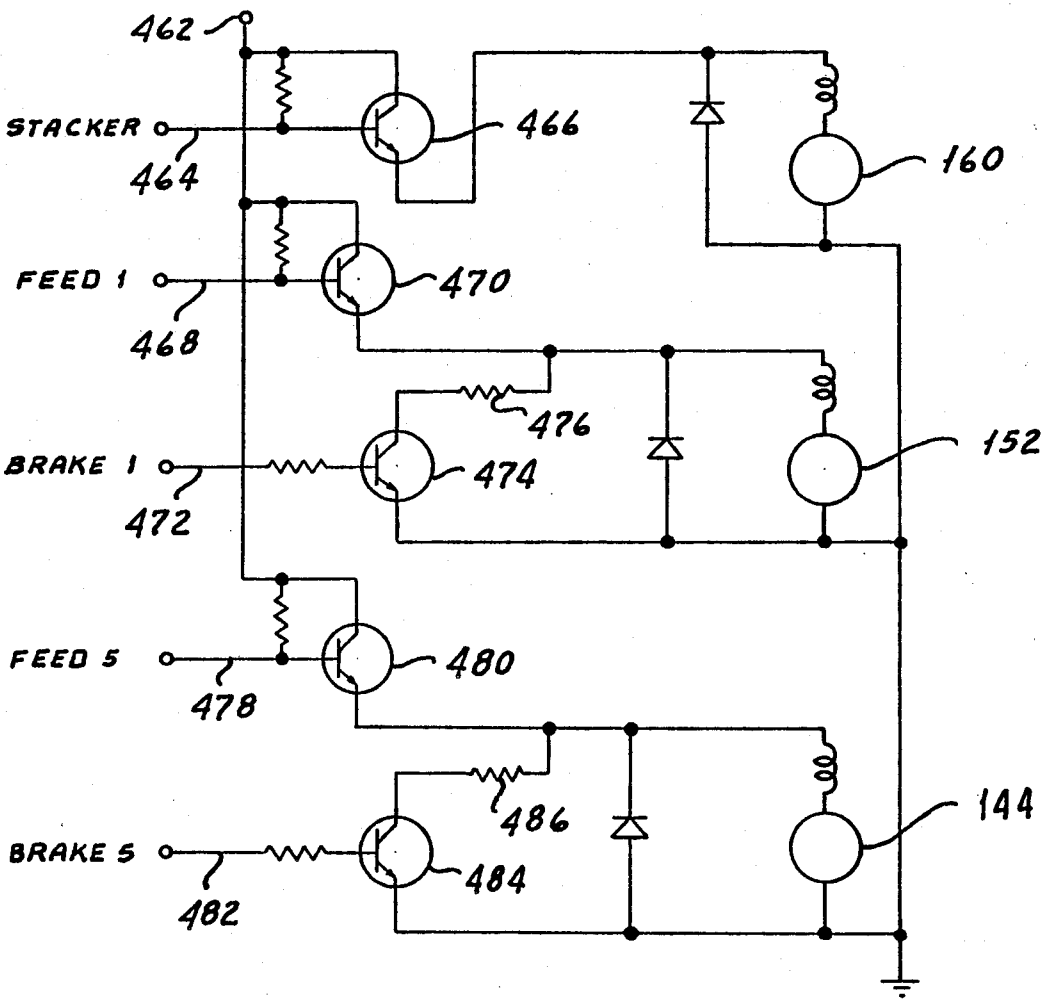
FIG. 17 is a diagrammatic view of a still further portion of the microprocessor board of our simplified currency dispenser.
Figure 14:
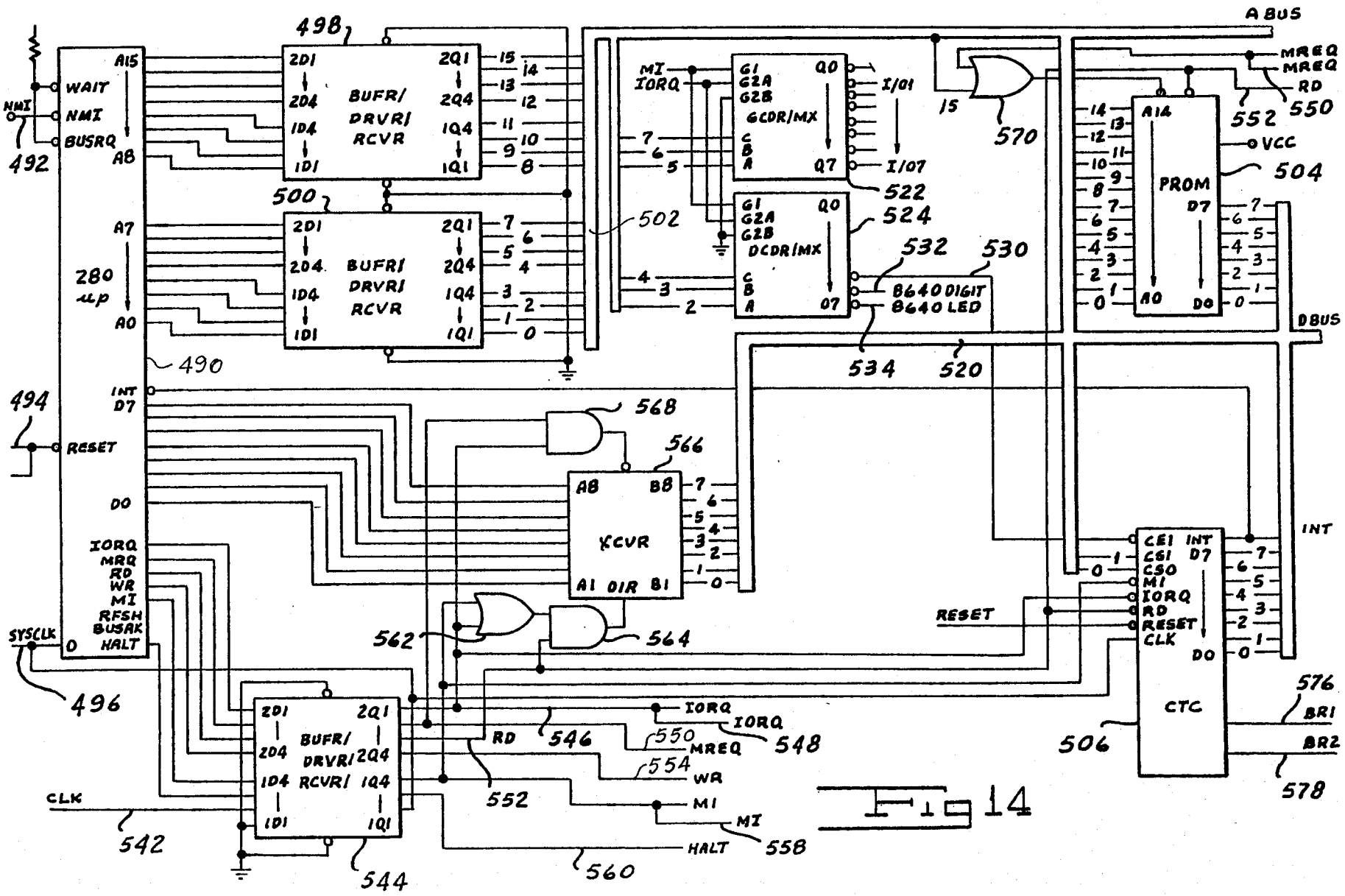
FIG. 14 is a diagrammatic view of a portion of the microprocessor board of our simplified currency dispenser.

Referring to FIG. 17, we apply the signals on conductors 434, 436, 458 and 456 to respective microprocessor operated switches 602, 604, 606 and 608. Respective inverters apply the signals on lines 596, 600, 594 and 598 to the switches 602, 604, 606, and 608 to couple the signals on line 434, 436, 458 and 456 to the analog's digital converter 540. In addition to the I03 signal from chip 522, the converter 540 receives write and read signals on lines 552 and 554.

Turning now to FIG. 18, switches **610*a* to 610*h* provide inputs for chip 528** to set up the particular software which is to be used. More specifically, the switches are so operated as to tell the microprocessor, for example, whether it is hooked up to a point of sale terminal or to the remote key pad.

The first octal flip-flop 536 which is clocked by the signal on line 534 feeds signals DBL, B100, B50, B25, B20, B10 and B5 to respective LEDs **614*a* to 614*g***.

The second octal flip-flop 538 which is clocked by the signal on line 532 provides respective output signals DIG4, DIG3, DIG2, DIG1, BCD8, BCD4, BCD2 and BCD1 leading to the display board illustrated in FIG. 19.

Referring now to FIG. 19, we apply inputs as indicated to circuit components 618 and 620 to provide four groups of outputs indicated as al to gl, a2 to g2, a3 to g3 and a4 to g4, to illuminate LEDs making up a four digit number.

Referring now to FIGS. 20 through 29, we have shown the flow chart of the program which controls our apparatus. Beginning at START in FIG. 20, the RAM 508 is first tested. If this test is unsuccessful, as indicated by SYSERR, proceed to FIG. 24 display "Help" and halt the program. If the test is successful, the input/output circuits, the RAM and the INTERRUPTS are initialized. Next, the display is actuated to show an indicating designation, such for example as "8902" which may be the model number of the apparatus. In addition, the pending INTERRUPTS are cleared and the timer circuits are set.

When the above has been accomplished, the program is at "BEGIN". The first determination to be made is whether or not the apparatus is in the COUNT mode. As has been pointed out hereinabove, the system normally is in the dispense mode. It is placed in the count mode by actuating the START/CLEAR button 266. If the answer is yes, proceed to FIG. 26 and continue in a manner to be described hereinbelow. Assuming that the system is not in the COUNT mode, proceed to "DISPENSE" in FIG. 21. The DIP switches 610*a* to 610*h* are read and the interface selected. When that has been done a determination is made if the supply of ones or of fives is low. If so, "LO" is displayed one second from the last display and the system returns to "BEGIN" in FIG. 20.

If neither the supply of ones nor the supply of fives is low, a check is again made to see if the switch is set to the COUNT mode. If so, as before, the system proceeds to the "COUNT MODE" of FIG. 26. If the switch is not set to the COUNT mode, a check is made to determine whether or not the data from the keyboard or other source has been read in. If not, the system returns to the ones or fives pocket low decision. If the data has been read in, proceed to "CALCULATE" in FIG. 22. At this point, the amount to be dispensed is displayed and a calculation is made of the number of ones and the number of fives required to make up that amount. For example, if $18.00 is to be dispensed, a calculation is made that three ones and three fives are to be dispensed for a total of documents or bills of six.

Next, a check is made to determine if the system has called for more than twenty documents to be dispensed. If so, the system goes to "ERRORS" in FIG. 25, displays "Help" and halts the program.

If the system indicates that not more than twenty documents have been called for, a decision is made as to whether or not any fives are to be dispensed. If so, a check is made to determine whether or not there are any fives in the supply tray. If so, a five dollar note is dispensed and the system proceeds to determine whether or not any errors have occurred. If so, the system again proceeds to FIG. 25 to display "Help" and halt the program. If no errors have occurred, the system returns to the determination of whether or not there are any fives to dispense. If more fives are to be dispensed, a check again is made if there are any fives in the pocket. If so, another five is dispensed and the system proceeds.

Figure 23:
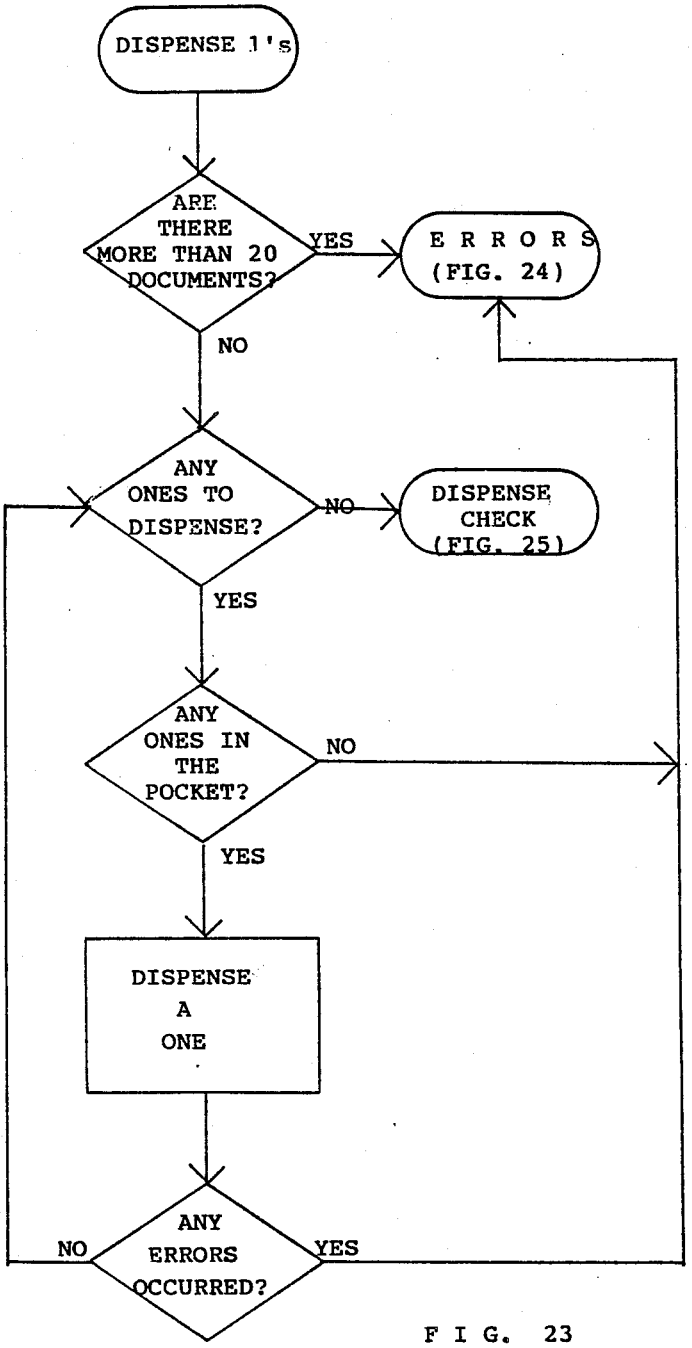
Figure 24:
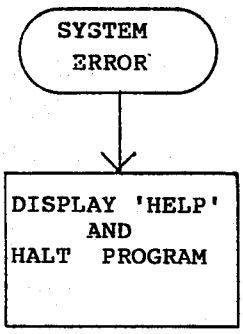
Figure 25:
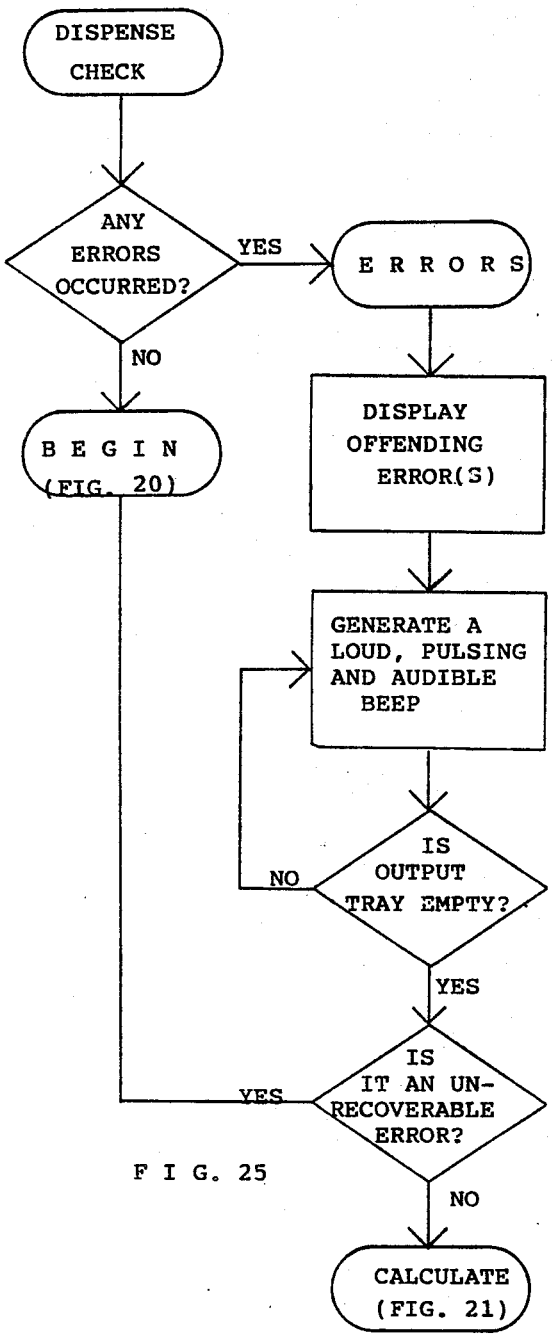

When no more fives have been called for, the system proceeds to the "DISPENSE 1's" terminal of FIG. 23. It is to be noted that if the system calls for a five to be dispensed and no fives remain in the supply, the amount of leftover fives is added to the number of ones required to be dispensed before the system proceeds to the "DISPENSE 1's" terminal of FIG. 23.

Prior to dispensing the number of ones called for, a check is made to determine whether or not more than twenty documents are required. If so, the system returns to FIG. 24, displays "Help" and halts the program. If no more than twenty documents have been called for, a check is made to see whether or not there are any ones to be dispensed. If so, the system proceeds to determine whether or not there are available any ones in the supply. If not, the dispensing operation called for obviously cannot be fulfilled and the system goes back to FIG. 4, displays "Help" and halts the program. If there are ones available to be dispensed, a one is dispensed and a check is made to see if any errors have occurred. If an error has occurred, the program proceeds to FIG. 24 to cause "Help" to be displayed and to halt the program. If no error has occurred, the program returns to the decision of whether or not any ones are to be dispensed. If so, it proceeds as before. If not, the dispensing operation ostensibly is complete and the program proceeds to the "DISPENSE CHECK" terminal of FIG. 25.

From the "DISPENSE CHECK" terminal, a decision is made as to whether or not any errors have occurred. If no errors have occurred, the system returns to "BEGIN" in FIG. 20. If an error has occurred, the offending error or errors are displayed. Examples of errors which might be detected are "half note" where a piece of a bill which has been torn into two pieces is detected and "chain note" indicating that overlapping bills have passed through. These errors are displayed on the display 378 as "E1" and "E2" or the like. At the same time a loud, pulsing and audible beep is generated. The system then checks to determine whether or not the output tray is empty. If not, the loud, pulsing and audible beep continues to be generated to alert the operator to empty the output tray before the system will proceed. If the output tray is empty, a determination is made of whether or not the error is unrecoverable. If it is an unrecoverable error, the program returns to "BEGIN" in FIG. 20. If the error is recoverable, it returns to the "CALCULATE" terminal in FIG. 21.

Figure 20:
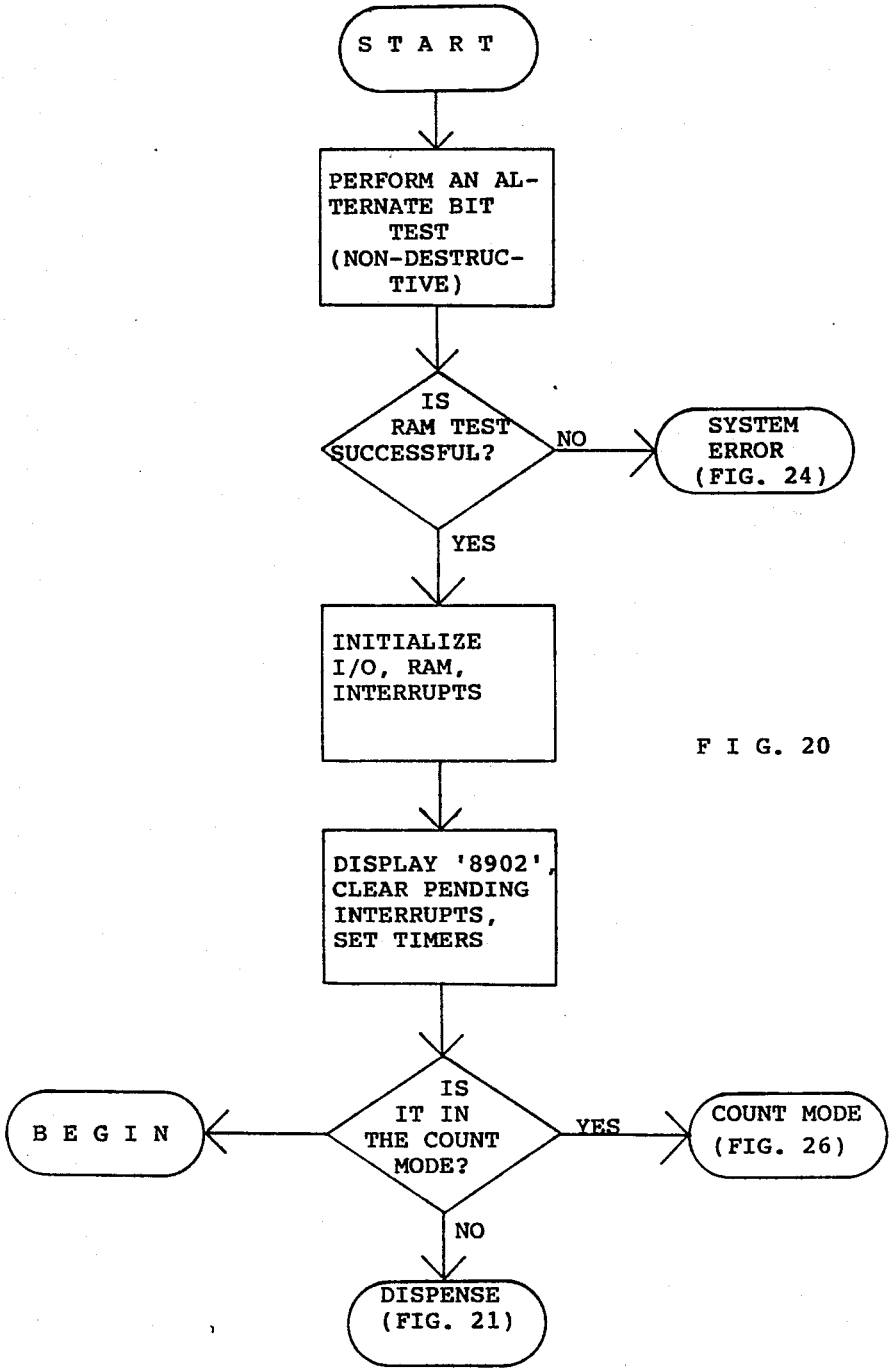
FIGS. 20 through 29 make up a flow diagram of the control program of our simplified currency dispenser.
Figure 21:
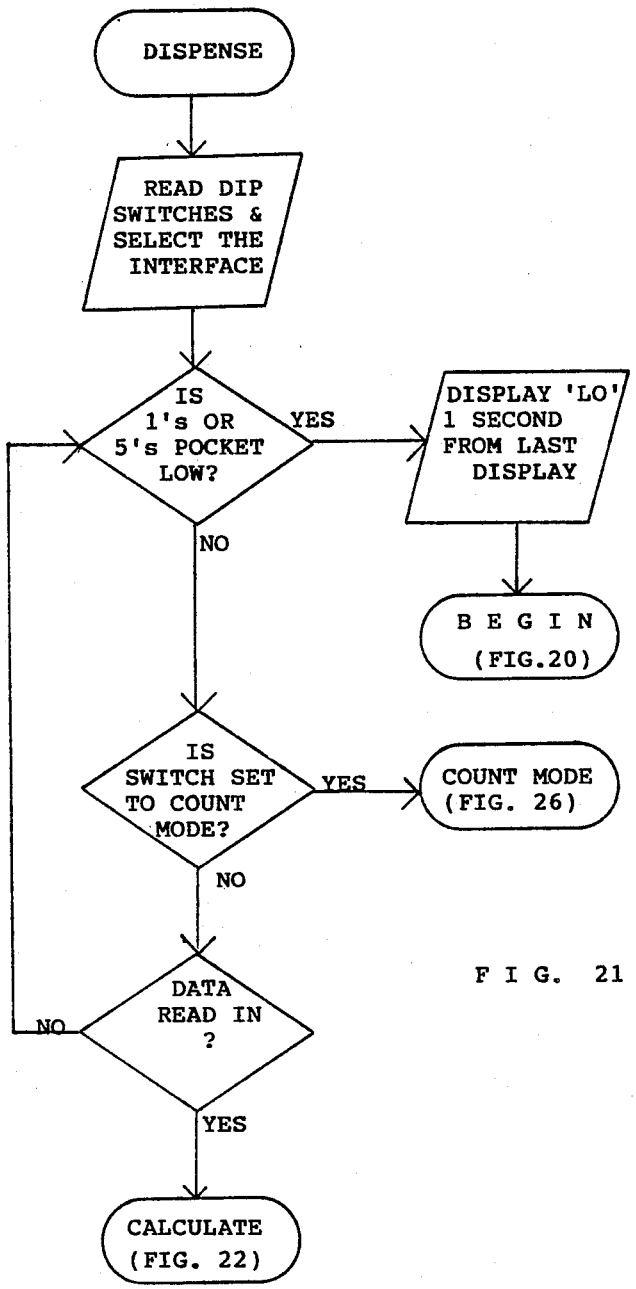
Figure 22:
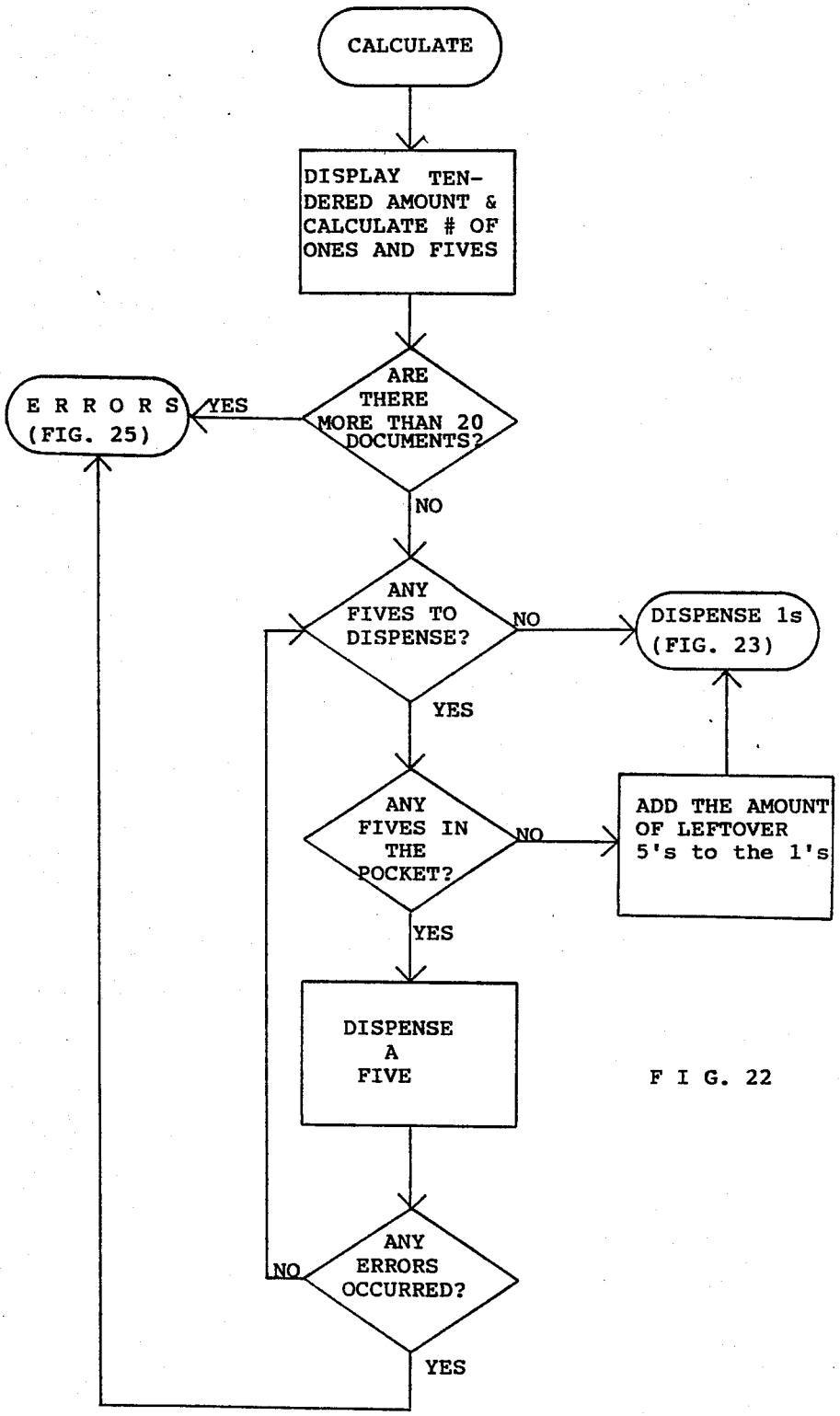
Figure 26:
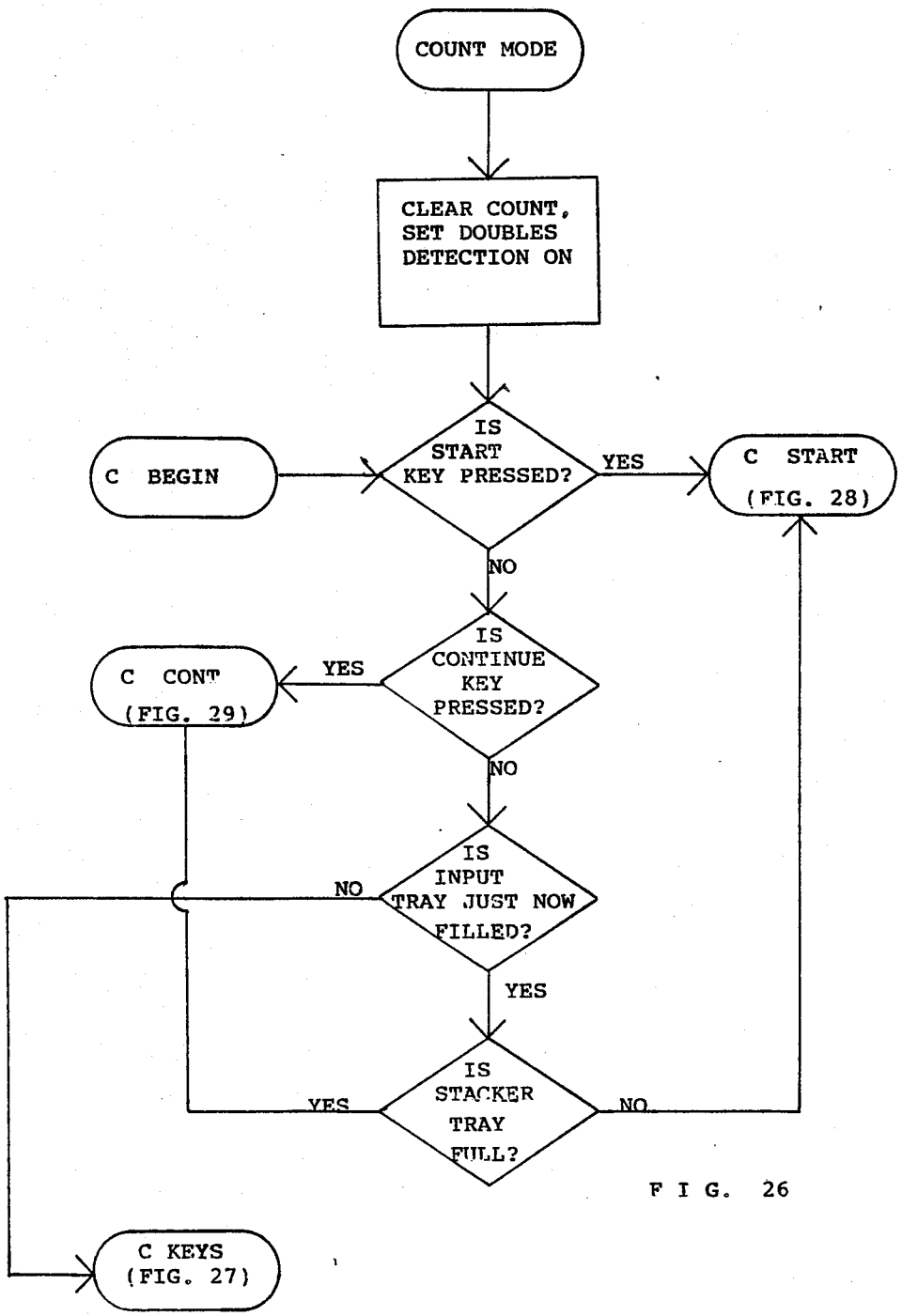

Assuming that the system had been set in the COUNT mode as indicated by the decision box in FIG. 20 so that the program proceeded to the "COUNT" mode terminal of FIG. 26, first the count is cleared and the doubles detection is set on. A determination is then made of whether or not the START key has been pressed. If so, the program proceeds to the "C-START" terminal of FIG. 28. At this point the system first clears the count and resets the batch count. Next, errors are cleared. A determination then is made of whether the count is higher than the batch. If so, the count and batch count are reset, a document is moved from the input tray to the output tray, and the display and batch count are bumped. If a determination had been made that the count was not higher than the batch count, the program proceeds directly to dispense a document and bump the display and batch counts. After a document has been dispensed and the display and batch counts bumped, the system proceeds to the "C-CHECK" terminal of FIG. 29.

A check of the doubles detector is made to see whether or not an error has occurred. If not, the system proceeds directly to determine whether or not any other errors have occurred. If a doubles error is indicated, a check is made to see whether or not the doubles detection system is active. If not, the system proceeds to determine whether or not any other errors exist. If the doubles detection system is active and a double errors has been indicated, the program proceeds to display the error and stop the counter. If there is no doubles error or the double detection system is not active and another error is not detected, the program proceeds to the "C-NEXT" terminal in FIG. 28 to continue the count.

If an error has been detected and the counter has been stopped, a check is then made to see if the output tray is empty. If it is, the program returns to the "C-BEGIN" terminal of FIG. 26. If an error has been detected and the output tray is not empty, a check is made to see whether or not the CONTINUE or START key is pressed. If not, the program returns to the determination of whether or not the output tray is empty. If an error has been detected and the output tray is not empty and one of the CONTINUE or START keys has been pressed, the system sounds a short beep to remind the operator to empty the output tray and the program returns to the determination of whether or not the tray is empty If the tray is empty, the program returns to the "C-BEGIN" terminal of FIG. 26.

If, following a determination that a system is in the COUNT mode, a determination also is made that the START key has not been pressed, the system makes a decision as to whether or not the continue key has been pressed. If so, the program goes to the "C-CONT" terminal of FIG. 28 leading to the clear errors operation and the program proceeds as before. If the CONTINUE key has not been pressed, a check is made to see whether the input tray has just now been filled. If so, the system checks to determine whether or not the stacker tray is full. If not, the program proceeds to the "C-START" terminal of FIG. 28. If the stacker tray is full the program proceeds to the "C-CONT" terminal of FIG. 28.

Figure 27:
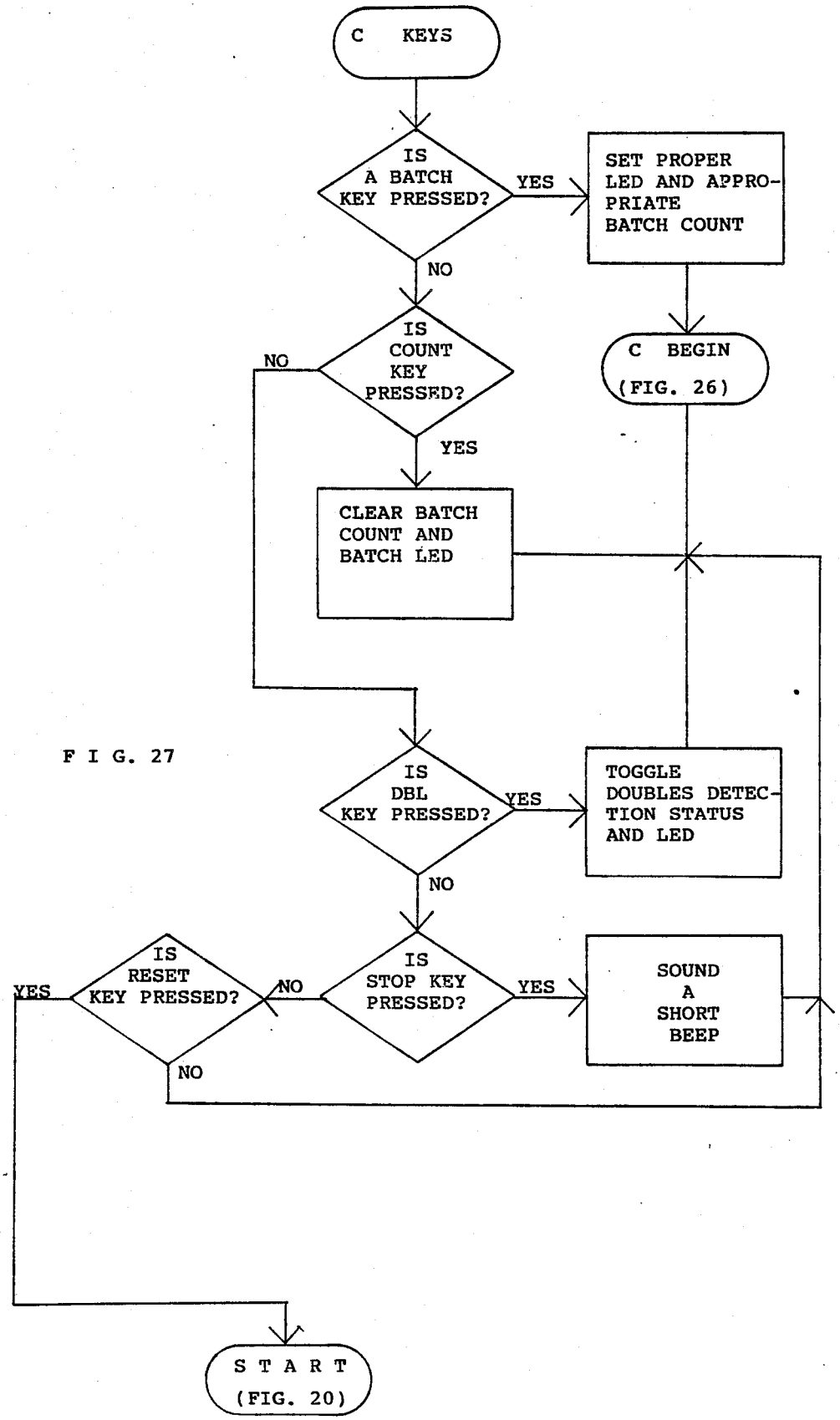
Figure 28:
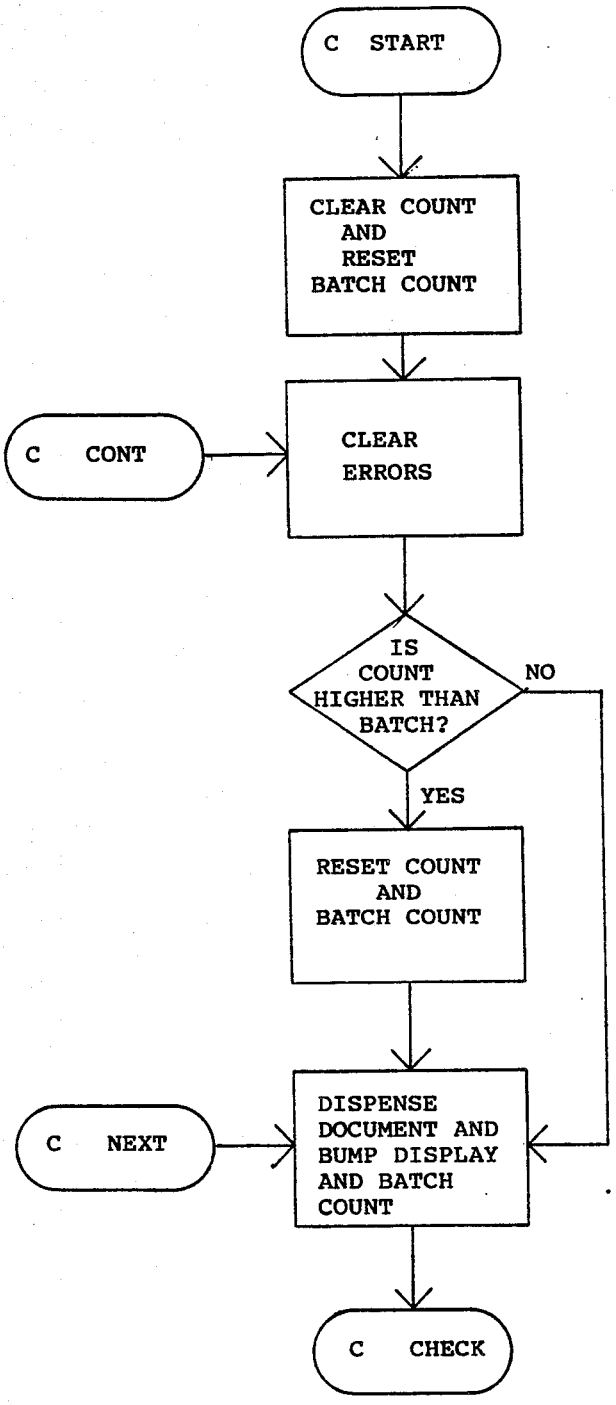
Figure 29:
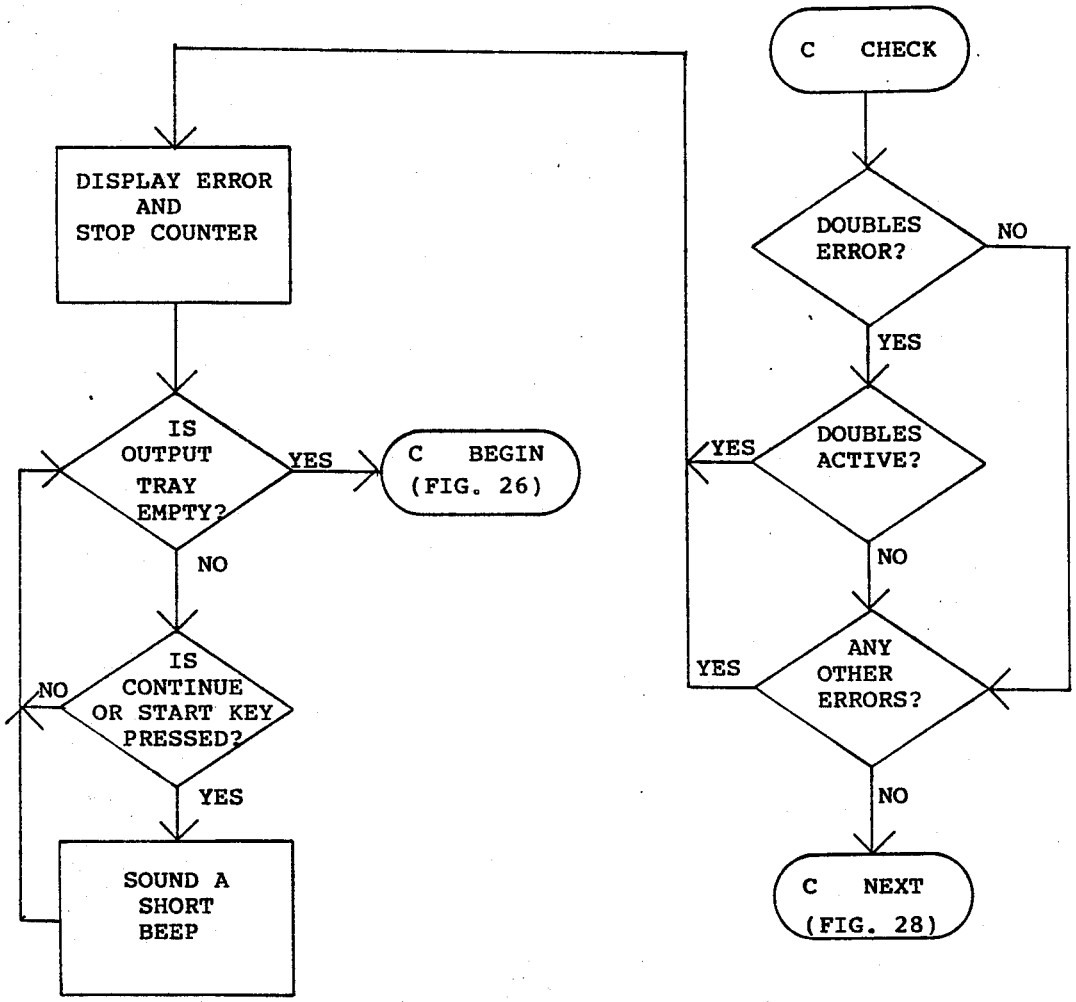

If, following a determination that neither the START key nor the CONTINUE key has been pressed and the input tray has not just now been filled, the program goes to the "C-KEYS" terminal of FIG. 27. A determination is then made of whether or not a batch key has been pressed. If so, the proper LED and appropriate batch counts are set and the program goes to the "C-BEGIN" terminal of FIG. 26.

If no batch key has been pressed, a check is made to see if the COUNT key has been pressed. If so, the batch count and batch LED are cleared and the system goes to the "C-BEGIN" block of FIG. 26.

If neither the batch key nor the count key has been pressed, a check is made to see if the double key has ben pressed. If so, the doubles detection status and LED are toggled and the program goes back to the "C-BEGIN" block of FIG. 26. If none of the batch keys or the count key or the double key is pressed, a check is made to see whether or not the stop key is pressed. If, under these conditions, the stop key has not been pressed, the system checks to see if the reset key has been pressed. If so, the program returns to the START terminal of FIG. 20. If the stop key has been pressed, a short beep is sounded and the program returns to the "C-BEGIN" block of FIG. 26. If neither the stop key nor the reset key has been pressed, the program returns to the C-BEGIN block of FIG. 26. If the stop key is not pressed but the reset key has been pressed, the program returns to the START block of FIG. 20.

The operation of our simplified currency dispenser will be apparent from the description given hereinabove. In the normal operation of the device in the dispense mode, wherein change is to be given to a customer in response to payment for merchandise, the operator first punches in the cost of the purchase on keys 373. The aggregate is displayed. Next, the amount tendered by the customer is entered and displayed and the display then shows the amount to be given in change. The amount in bills is determined in terms of the number of five dollar bills and the number of one dollar bills required to make the change. Where there are not enough five dollar bills to make up the required number, a number of ones equal to the same amount is added to the number of ones to be dispensed. The unit then operates first dispensing five dollar bills from unit 42 and then dispensing one dollar bills from unit 40 until the required amount of bills in change has been delivered to the output tray 208.

To cause the unit to operate in the count mode, the START CLEAR button 266 is pressed to set it in the count mode. The bills to be counted then are placed on the tray 120 and the unit begins to count. It may be operated in the batch count mode.

In the course of dispensing or counting operations, errors are detected and displayed on the operative display as coded signals.

It will be seen that we have accomplished the objects of our invention. We have provided a simplified currency dispenser which is especially adapted for use at a location at which a high volume of relatively low dollar amount transactions are being carried out. Our simplified currency dispenser is accurate and reliable. It is simple, compact and inexpensive. It is relatively easy to construct and to service.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Apparatus for dispensing a predetermined mix of bills from respective supplies of bills of different denominations including in combination, an upper casing section, respective first and second means in said upper casing section for holding said supplies of bills of different denominations, first means in said upper casing section adapted to be driven to advance a bill from said first supply toward a delivery location, second means in said upper casing section adapted to be driven to advance a bill from said second supply toward said delivery location, a lower casing section, first and second prime movers in said lower casing section, means for detachably connecting said upper and lower casing sections, and means for connecting the respective prime movers to said advancing means.

2. Apparatus as in claim 1 including an output tray on said lower casing section, a stacker on said lower casing section adapted to be driven to deliver received bills to said output tray, a third prime mover in said lower casing section and means coupling said third prime mover to said stacker.

3. Apparatus as in claim 2 in which said first advancing means is relatively adjacent to said delivery location and delivers bills directly to said stacker, said second advancing means being relatively remote from said delivery location to advance bills to an intermediate location, a first transport element in said upper casing section, a second transport element in said lower casing section, and means coupling said second transport element to said third prime mover, said first and second transport elements coming into operative relationship in response to assembly of said upper and lower casing sections to form a transport device for carrying bills from said intermediate location to said stacker.

4. Apparatus as in claim 1 including an output tray on said upper casing section, a stacker on said upper casing section adapted to be driven to deliver received bills to said output tray, a third prime mover in said lower casing section and means coupling said third prime mover to said stacker.

5. Apparatus for depositing currency notes at a delivery location including in combination, a housing, means on said housing for holding a first supply of notes of one denomination, means on said housing for holding a second supply of notes of a different denomination, first means for moving notes from said first supply to said delivery location, second means for moving notes from said second supply to said delivery location, operating means comprising means for alternatively setting said apparatus in a count mode in which only said first moving means is operative or in a dispenser mode in which both said first moving means and said second moving means are operative, count generating means responsive to said moving means for providing a count equal to the number of notes moved from said first supply to said delivery location in said count mode of said apparatus and for providing a count representing the aggregate monetary value of notes moved to said delivery location from said first and second supplies in the dispense mode of the apparatus, and means responsive to said setting means for providing a visual indication of the aggregate monetary value to be dispensed in said dispense mode and responsive to said setting means and said first moving means for providing a visual indication of the number of notes moved from said first supply to said delivery location in said count mode.

6. Apparatus as in claim 5 in which operating means comprises first key means on said housing and second key means remote from said housing.

7. Apparatus as in claim 6 in which said display means comprises a first visual indication means on said housing and a second visual indication means remote from said housing.

8. Apparatus as in claim 7 in which said first key means controls the operation of said apparatus in the count mode and in which said second key means controls the operation of the apparatus in the dispense mode.

9. Apparatus for dispensing bills from a supply to a delivery area including in combination an upper casing section, means in said upper casing section for holding a supply of bills at a position relatively remote from said delivery area, means for removing bills one at a time from said supply and for advancing removed bills to a location spaced from said delivery area, means for detachably assembling said upper and lower casing sections, a first transport element in said upper section and a second transport element in said lower section, said first and second transport elements coming into operative relationship upon assembling of said casing sections to form transport means for carrying notes from said location to said delivery area.

10. Apparatus for selectively dispensing bills from respective supplies to a delivery area including in combination an upper casing section, means in said upper casing section for holding a first supply of bills at a position relatively adjacent to said delivery area, means in said upper casing section for holding a second supply of bills at a position relatively remote from said delivery area, means for removing bills one-at-a-time from said first supply and for advancing bills toward said delivery area, means for removing bills one-at-a-time from said second supply and for advancing said bills to a location spaced from said delivery area, a lower casing section, means for detachably assembling said upper and lower casing sections, a first transport element in said upper section and a second transport element in said lower section, said first and second transport elements coming into operative relationship upon assembly of said casing sections to form transport means for carrying notes from said location to said delivery area.

11. Apparatus for selectively dispensing bills from a supply to a delivery area including in combination means for holding a supply of bills at a position relatively remote from said delivery area, means comprising a first prime mover adapted to be energized to remove bills one at a time from said supply and for advancing said bills to a location spaced from said delivery area, transport means comprising a second prime mover adapted to be energized to carry bills from said location to said delivery area and means for inhibiting build-up bills at said location in the event that said first prime mover is energized and said second prime mover is not, said bill removing and advancing means comprising a shaft driven by said first prime mover, said inhibiting means comprising a first roller, an overrunning clutch supporting said first roller on said shaft, and a second roller driven by said second prime mover, said second roller being in driving engagement with said first roller, said first and second rollers forming part of said transport means.

12. Apparatus for dispensing a predetermined mix of bills of higher and lower denominations including in combination, means for holding a first stack of bills of said higher denomination, means for holding a second stack of bills of said lower denomination, first means adapted to be activated to advance bills from the bottom of said first supply toward a first location below the bottom of said first stack, second means adapted to be actuated to advance bills from the bottom of said second supply toward a second location below the bottom of said second stack, a delivery tray, means mounting said delivery tray at a third location spaced above said first and second locations, a stacker mechanism at said third location, said stacker mechanism comprising a stacker wheel and a shaft adapted to be driven to cause said stacker wheel to deposit bills delivered thereto on said tray, a single conveyor belt common to said first and second and third location, a pulley on said shaft for receiving said conveyor belt, means at said first location forming a nip with said belt for receiving bills from said first advancing means, means at said second location forming a nip with said belt for receiving bills from said second advancing means and means for driving said belt and said shaft to cause said belt to convey bills from said first and second locations to deliver said bills to said stacker wheel at said third location and to cause said stacker wheel to deposit said bills on said tray.

13. Apparatus as in claim 12 including a first hold-down roller engaging said belt between said first and second locations.

14. Apparatus as in claim 12 including a second hold-down roller between said second location and said delivery location.

* * * * *

UNITED STATES PATENT AND TRADEMARK OFFICE

CERTIFICATE OF CORRECTION

PATENT NO. : 4,903,953

DATED : Feb. 27, 1990

INVENTOR(S) : Theodore Winkler, Peter L. Helgeson, William Sherman III, Thomas B. Snow It is certified that error appears in the above-identified patent and that said Letters Patent is hereby corrected as shown below:

Column 15, line 32 - amend "dispenser" to -- dispense --.

Column 15, line 48 - after "which", insert -- said --.

Signed and Sealed this

Fourth Day of December, 1990

*Attest:*

HARRY F. MANBECK, JR.

*Attesting Officer*

*Commissioner of Patents and Trademarks*